US009707147B2

(12) United States Patent
Levital et al.

(10) Patent No.: US 9,707,147 B2
(45) **Date of Patent: *Jul. 18, 2017**

(54) "TEACH AND REPEAT" METHOD AND APPARATUS FOR PHYSIOTHERAPEUTIC APPLICATIONS

(75) Inventors: Tamir Levital, Ramat Gan (IL); Yaron Moshe River, Qiryat Tivon (IL)

(73) Assignee: HEADWAY LTD., Kiryat Ono (IL)

( * ) Notice: Subject to any disclaimer, the term of this patent is extended or adjusted under 35 U.S.C. 154(b) by 1010 days.

This patent is subject to a terminal disclaimer.

(21) Appl. No.: 13/493,104

(22) Filed: Jun. 11, 2012

(65) Prior Publication Data

US 2012/0253241 A1 Oct. 4, 2012

Related U.S. Application Data

(63) Continuation-in-part of application No. PCT/IL2010/001070, filed on Dec. 16, 2010.
(Continued)

(51) Int. Cl.
*A61H 1/02* (2006.01)

(52) U.S. Cl.
CPC ..... *A61H 1/0296* (2013.01); *A61H 2201/018* (2013.01); *A61H 2201/02* (2013.01);
(Continued)

(58) Field of Classification Search
CPC ..... A61H 1/00; A61H 1/0296; A61H 1/001; A61H 1/0218; A61H 1/0222;
(Continued)

(56) References Cited

U.S. PATENT DOCUMENTS 3,188,079 A 6/1965 Boetcker et al.
4,736,736 A 4/1988 Moers et al.
(Continued)

FOREIGN PATENT DOCUMENTS

JP 5038307 A 2/1993
WO 2008/059497 A2 5/2008

OTHER PUBLICATIONS

International Search Report and Written Opinion dated May 9, 2011 in corresponding International Application No. PCT/IL2010/001070.

(Continued)

*Primary Examiner* — Justine Yu
*Assistant Examiner* — Kathrynn Lyddane

(57) ABSTRACT

The present invention provides a device which can generate commands for controlling a physical therapy apparatus adapted to accept external commands. The device has a base, a motion manipulation portion and a moveable portion of substantially the same shape and dimensions as the portion of the physical therapy apparatus which interacts with at least one part of the body of a patient. The device also includes conversion means for converting stored time-dependent output signals to a series of command signals and means for transmitting the command signals to the physical therapy apparatus. The command signals are produced by the movements of the moveable portion, and, when transmitted to the physical therapy apparatus, can induce the physical therapy apparatus to undergo a series of motions substantially identical to those of the moveable portion.

24 Claims, 20 Drawing Sheets

Related U.S. Application Data

(60) Provisional application No. 61/287,199, filed on Dec. 17, 2009.

(52) U.S. Cl.
CPC ..... *A61H 2201/1659* (2013.01); *A61H 2201/5038* (2013.01); *A61H 2201/5048* (2013.01); *A61H 2201/5064* (2013.01); *A61H 2201/5079* (2013.01); *A61H 2201/5084* (2013.01); *A61H 2201/5097* (2013.01); *A61H 2203/0456* (2013.01); *A61H 2203/0468* (2013.01); *A61H 2230/06* (2013.01); *A61H 2230/10* (2013.01); *A61H 2230/30* (2013.01); *A61H 2230/60* (2013.01); *A61H 2230/65* (2013.01)

(58) Field of Classification Search
CPC ..... A61H 1/0237; A61H 1/0262; A61H 2201/1604; A61H 2201/1607; A61H 2201/1609; A61H 2201/1611; A61H 2201/5084
See application file for complete search history.

(56) References Cited

U.S. PATENT DOCUMENTS

| | | | | |
|---|---|---|---|---|
| 5,320,641 | A | 6/1994 | Riddle et al. | |
| 5,456,655 | A | 10/1995 | Van Morris | |
| 5,578,060 | A | 11/1996 | Pohl et al. | |
| 6,971,997 | B1 | 12/2005 | Ryan et al. | |
| 7,381,192 | B2 * | 6/2008 | Brodard et al. | 601/5 |
| 8,485,195 | B2 * | 7/2013 | River | A61H 1/0296 128/830 |
| 8,690,802 | B2 * | 4/2014 | Sankai | 601/35 |
| 2002/0010056 | A1 * | 1/2002 | Borsheim | 482/66 |
| 2004/0171974 | A1 | 9/2004 | Emsky | |
| 2008/0076979 | A1 | 3/2008 | Gentempo et al. | |
| 2008/0104763 | A1 | 5/2008 | Brown et al. | |
| 2009/0062698 | A1 | 3/2009 | Einav et al. | |
| 2009/0272385 | A1 * | 11/2009 | River | A61H 1/0296 128/845 |
| 2010/0152629 | A1 * | 6/2010 | Haas et al. | 601/34 |

OTHER PUBLICATIONS

International Search Report for PCT/IL2007/001403, dated Jun. 10, 2008.

Written Opinion of the International Search Authority for PCT/IL2007/001403, dated Jun. 10, 2008.

International Preliminary Report on Patentability Chapter I for PCT/IL2007/001403, dated May 19, 2009.

* cited by examiner

| Paired Stats | *p* value |
|---|---|
| Wk 1 Vs. Wk 4 | **0.022** |
| Wk 1 Vs. Wk 6 | **0.009** |
| Wk 1 Vs. **Wk 8** | **0.049** |

"TEACH AND REPEAT" METHOD AND APPARATUS FOR PHYSIOTHERAPEUTIC APPLICATIONS

FIELD OF THE INVENTION

The present invention generally relates to means controlling for physiotherapy devices, in particular, for directing motions of devices designed to treat, control, or prevent skeletal or musculoskeletal pain.

BACKGROUND OF THE INVENTION

An important salient feature of chronic head and neck pain syndromes is muscle dysfunction. Whatever the origin of pain (trauma, pathology of the cervical spine, etc.), patients frequently develop lateral, anterior and posterior neck muscle activation imbalance, muscle fatigue, muscle shortening, and over-contraction of agonist and antagonist muscles. Subsequently, muscle hyperalgesia and reduced neck range of motion is induced. This hyperalgesia is a part of a vicious cycle of pain mechanism. Mobilization and/or physical therapy are effective for some patients, whereas for other patients, biofeedback relaxation techniques are helpful. In many cases, the therapeutic protocol involves a set of motions that are repeated cyclically. A number of devices have been developed that are designed to provide at least some degree of automation to the therapeutic protocol.

U.S. Pat. No. 5,320,641 discloses a device for spinal rehabilitation, allowing a limited elevation/depression of different parts of the spinal column, not necessarily the cervical spine. The device allows only one degree of freedom, no true feedback from the patient. It mainly relates to post operative treatment and not for the treatment of headache and/or neck pain. It is mainly focused on enlarging the flexion/extension range of movement of the neck post trauma, post surgery.

Japanese Pat. No. 5,038,307 describes a seat for a vehicle having variable air pressure mats within. Electromyograph signals are taken of the driver's body. When these signals indicate that the driver is tired, the air pressure of the seat is varied. However this variation is not intended to relax the driver but rather to increase his level of alertness while driving. The pattern of inflation is therefore not adapted to decrease the electromyographic potentials indicating muscle tension by use of feedback. Since the head and neck are not specifically stimulated by this cradle, it is unlikely that the cradle is adapted to provide relief from headaches or muscle tension. It does not reposition the head and neck in a manner similar to physical therapy adjustment. Finally, it does not determine the ideal degree of movement for each individual, nor does it maintain a computerized record of such.

U.S. Pat. No. 5,320,641 discloses a computer-controlled physical therapy device. This device is designed for treatment of a patient's back. It provides support for the back and the option of providing a predetermined pivoting (axial) motion. The actuators for the pivoting motion are computer controlled. This device makes no provision for rotational motion of the patient, and changes in the treatment protocol are performed by direct keyboard input to the computer.

U.S. Pat. No. 5,578,060 discloses an interactive physical therapy apparatus. This apparatus likewise provides for computer control. An operator can input into the computer specific treatment parameters, in particular, which body part is to be selected for treatment.

There remains, however, a long-felt need for a physical therapy system that permits input of treatment protocols (e.g. the direction and duration of the motions of the treatment apparatus) by means other than direct input of desired parameters; in which the control system is able to provide a treatment protocol for motions with six degrees of freedom (three translational and three rotational); and which provides the option of true feedback, in which the control apparatus modifies the treatment protocol according to parameter's related to the state of the patient during the course of the treatment.

SUMMARY OF THE INVENTION

The present invention is designed to meet this long-felt need. It presents a physical therapy method and device in which the manipulations of a patient's body or part thereof can be controlled remotely by any one of a number of means. It also provides for automation of the remote control, as well as for a variety of feedback mechanisms by which the patient or caregiver can interact with the system in real time to modify the original treatment protocol.

It is therefore an object of the present invention to disclose a device for controlling a physical therapy apparatus adapted for accepting external commands, said device comprising: (a) a moveable portion of substantially the same shape and dimensions as that portion of said physical therapy apparatus that is adapted for interacting with at least one part of the body of a patient; (b) a base; (c) a motion manipulation portion, said motion manipulation portion comprising: (i) connecting means adapted for connecting one end of said motion manipulation portion to said moveable portion; (ii) connecting means adapted for connecting the other end of said motion manipulation portion to said base; (iii) a plurality of sensors adapted for making time-dependent measurements of at least one of (1) direction of motion, (2) velocity, and (3) acceleration of said moveable portion along each degree of freedom of its motion; (iv) means for converting each of said time-dependent measurements into at least one time-dependent output signal proportional to said measurement; and, (v) means for transmitting each of said at least one time-dependent output signals to a transceiver; (d) a transceiver adapted for receiving each of said at least one time-dependent output signals and transmitting each of said at least one time-dependent output signals to a storage means; (e) storage means adapted for storing said time-dependent output signals transmitted from said transceiver; (f) conversion means for converting said stored time-dependent output signals to a series of command signals; and (g) means for transmitting said command signals to said physical therapy device. It is within the essence of the invention wherein moving said moveable portion produces a series of command signals, which, when transmitted to said physical therapy apparatus, will cause said physical therapy apparatus to undergo a series of motions substantially identical to those of said moveable portion.

It is a further object of this invention to disclose such a device, wherein at least one of said sensors are selected from a group consisting of stereoscopic (3D) cameras adapted for motion detection, image capture equipment adapted for tracking and recording motion or any combination thereof. It is a further object of this invention to disclose such a device, additionally comprising means adapted to maintain said patient in a predetermined position on a treatment bed It is a further object of this invention to disclose such a device, wherein said connecting means adapted for connecting one end of said motion manipulation portion to said moveable portion are further adapted such that linear motions of said moveable portion retain three degrees of freedom and rotational motions of said movable portion retain three degrees of freedom.

It is a further object of this invention to disclose such a device, wherein the cradle can mobilized by the caregiver and/or the device to move the patient's head and neck in 3 planes of movement (6 degrees of freedom); said degrees of freedom are selected from a group consisting of 3 rotations, and 3 translations.

It is a further object of this invention to disclose such a device, wherein said transceiver is a computer board adapted for receiving signals from said at least one sensor.

It is a further object of this invention to disclose such a device, wherein at least one of said sensors are selected from a group consisting of stereoscopic (3D) cameras adapted for motion detection, image capture equipment adapted for tracking and recording motion or any combination thereof.

It is a further object of this invention to disclose such a device, wherein said storage means is a digital storage means.

It is a further object of this invention to disclose such a device, wherein said means for transmitting each of said at least one time-dependent output signals is chosen from the group consisting of (a) hardwired, (b) wireless.

It is a further object of this invention to disclose such a device, wherein said means for transmitting each of said command signals is chosen from the group consisting of (a) hardwired, (b) wireless.

It is a further object of this invention to disclose such a device as disclosed in any of the above, further comprising a computer and software adapted to allow a user to recall said signals from storage and to transmit said command signals to said physical therapy apparatus a predetermined number of times with a predetermined frequency.

It is a further object of this invention to disclose such a device, further comprising an interface and software adapted to allow direct input of information and conversion of at least a part of said information to time-dependent command signals.

It is a further object of this invention to disclose such a device as disclosed in any of the above, further comprising means for measuring and reporting at least one parameter related to the medical, physiological, or emotional status of a patient.

It is a further object of this invention to disclose such a device, wherein said at least one parameter related to the medical, physiological, and/or emotional status of a patient is chosen from the group consisting of (a) EMG, (b) ROM, (c) blood pressure, (d) EKG, (e) galvanic skin response (GSR), and (f) any combination of the above.

It is a further object of this invention to disclose such a device, wherein said reporting is provided to at least one module chosen from the group consisting of (a) adjacent to said physical therapy apparatus, (b) remote from said physical therapy apparatus.

It is a further object of this invention to disclose such a device, further comprising an interface between said detecting and said reporting means and said means for transmitting command signals to said physical therapy device.

It is a further object of this invention to disclose such a device, further comprising means for limiting by a predetermined amount at least one motion of said physical therapy device to a value lower than the analogous motion of said moveable part for at least part of the time during which at least one of said parameters related to the medical, physiological, and/or emotional status of a patient is within a predetermined set of values relative to a predetermined set of boundary conditions.

It is a further object of this invention to disclose such a device, further comprising means for increasing by a predetermined amount at least one motion of said physical therapy device above the value of the analogous motion of said moveable part for at least part of the time during which at least one of said parameters related to the medical, physiological, and/or emotional status of a patient is within a predetermined set of values relative to a predetermined set of boundary conditions.

It is a further object of this invention to disclose such a device as disclosed in any of the above, further comprising a voice recognition unit.

It is a further object of this invention to disclose such a device, wherein said voice recognition unit is interfaced with said means for transmitting a command signal to said physical therapy device.

It is a further object of this invention to disclose such a device, wherein said interface is adapted to perform, upon receipt by said voice recognition unit of an appropriate vocal command, at least one function chosen from the group consisting of (a) initiate a therapy session; (b) terminate a therapy session; (c) override said time-dependent command signals; (d) limit at least one motion of said physical therapy device; (e) extend at least one motion of said physical therapy device; and (f) any combination of the above.

It is a further object of this invention to disclose such a device as disclosed in any of the above, further comprising means for determining in real time the position and orientation of the body of a patient or at least one part thereof, said means chosen from the group consisting of (i) a camera system adapted for determining and reporting in real time the 3D position and orientation of an object such that said determination is provided by means of image processing; and, (ii) a plurality of sensors adapted to measure and report their positions in real time attached to said body of a patient or a part thereof, and/or to the movable portion, and/or to the caregiver's hands while tailoring the treatment course; wherein said time-dependent output signal is proportional to the time-dependent position and orientation and position of said body of a patient or a least one part thereof.

It is a further object of this invention to disclose such a device, wherein at least one of said sensors are selected from a group consisting of stereoscopic (3D) cameras adapted for motion detection, image capture equipment adapted for tracking and recording motion or any combination thereof.

It is a further object of this invention to disclose such a device as disclosed in any of the above, wherein said motions are selected from said allowed movements.

It is a further object of this invention to disclose such a device as disclosed in any of the above, wherein said motions are selected according to parameters characterizing said patient; said parameters are selected from a group consisting of any combination of physiological movements, in the sagittal (flexion-extension), coronal (right and left lateral banding) and horizontal (right and left rotation) planes of movement.

It is a further object of this invention to disclose a method for controlling a physical therapy apparatus adapted for receiving external commands, said method comprising steps of: (a) obtaining the device as disclosed in any of the above; (b) moving said moveable portion according to a predetermined protocol; (c) measuring the time-dependent positions of said moveable portion during the course of said predetermined protocol; (d) converting said measurements to a time-dependent signal; (e) transmitting said time-dependent signal to said transceiver; (f) storing said time-dependent signal by using said storage means; (g) converting said time-dependent signal to a time-dependent command signal; and (h) transmitting said time-dependent command signal to said physical therapy apparatus. It is within the essence of the invention wherein moving said moveable portion causes said physical therapy apparatus to undergo a series of motions substantially identical to those of said moveable portion.

It is a further object of this invention to disclose such a method, further comprising additional steps of: (i) recalling said time-dependent signal from said storage means; (j) converting said recalled time-dependent signal to a time-dependent command signal; (k) transmitting said time-dependent command signal to said physical therapy apparatus; and, (l) repeating steps (i) through (k) a predetermined number of times.

It is a further object of this invention to disclose such a method, additionally comprising step of maintaining said patient in a predetermined position on a treatment table. It is a further object of this invention to disclose a method for controlling a physical therapy apparatus adapted for transmitting at least one signal proportional to its orientation and further adapted for receiving external commands, said method comprising steps of: (a) manually altering the orientation of said physical therapy apparatus according to a predetermined protocol; (b) transmitting, during the course of said predetermined protocol, at least one time-dependent signal proportional to the orientation of said physical therapy apparatus to a storage device adapted for storing time-dependent signals; (c) storing said at least one transmitted time-dependent signal in said storage device; (d) recalling said time-dependent signal from said storage device; (e) converting said recalled time-dependent signal to a time-dependent command signal; (f) transmitting said time-dependent command signal to said physical therapy apparatus; and (g) repeating steps (d) through (f) a predetermined number of times. It is within the essence of the invention wherein transmitting said command signal causes said physical therapy apparatus to undergo substantially the same motions produced by said predetermined protocol.

It is a further object of this invention to disclose such a method, comprising the additional step of placing at least one body part in a position such that said alterations in the orientation of said physical therapy apparatus will manipulate said at least one body part according to a predetermined protocol.

It is a further object of this invention to disclose such a method, wherein said additional step of placing at least one body part in a position such that said alterations in the orientation of said physical therapy apparatus will manipulate said at least one body part according to a predetermined protocol occurs after step (c) and prior to step (d).

It is a further object of this invention to disclose such a method, additionally comprising step of maintaining said patient in a predetermined position on a treatment table.

It is a further object of this invention to disclose a method for controlling a physical therapy apparatus adapted for receiving external commands, said method comprising steps of: (a) obtaining an apparatus adapted for determining the time-dependent position and orientation of at least one body part of a subject and further adapted for transmitting a time-dependent signal proportional to said time-dependent position and orientation; (b) altering the position of said at least one body part according to a predetermined protocol; (c) measuring the time-dependent position and orientation of said at least one body part using said apparatus during the performance of said predetermined protocol; (d) transmitting a time-dependent signal proportional to the time-dependent position and orientation of said at least one body part during the performance of said predetermined protocol from said apparatus to a storage device; (e) recalling said time-dependent signal from said storage device; (f) converting said time-dependent signal to a time-dependent command signal; (g) transmitting said time-dependent command signal to said physical therapy apparatus; and (h) repeating steps (e) through (g) a predetermined number of times. It is within the essence of the invention wherein said command signal produces a series of alterations of the orientation of said physical therapy apparatus substantially identical to those necessary to manipulate the position and orientation of said at least one body part according to said predetermined protocol.

It is a further object of this invention to disclose such a method, wherein said step of obtaining an apparatus adapted for determining the time-dependent position and orientation of at least one body part of a subject and further adapted for transmitting a time-dependent signal proportional to said time-dependent position and orientation further includes a step of obtaining a camera system adapted for determining and reporting in real time the 3D position and orientation of an object by means of image processing.

It is a further object of this invention to disclose such a method, wherein said step of obtaining an apparatus adapted for determining the time-dependent position and orientation of at least one body part of a subject and further adapted for transmitting a time-dependent signal proportional to said time-dependent position and orientation further includes the additional steps of (a) obtaining a plurality of sensors adapted to measure and report their positions in real time; and (b) attaching said plurality of sensors to said at least one body part of a subject.

It is a further object of this invention to disclose such a method, additionally comprising step of maintaining said patient in a predetermined position on a treatment table.

It is a further object of this invention to disclose such a method, wherein at least one of said sensors are selected from a group consisting of stereoscopic (3D) cameras adapted for motion detection, image capture equipment adapted for tracking and recording motion or any combination thereof.

It is a further object of this invention to disclose such a method as disclosed in any of the above, further comprising the additional steps of: (a) measuring at least one parameter related to the medical, physiological, and/or emotional status of a patient; (b) reporting said at least one parameter related to the medical, physiological, and/or emotional status of a patient; and (c) limiting by a predetermined amount at least one motion of said physical therapy device to a value lower than the analogous motion of said moveable part for at least part of the time during which at least one of said parameters related to the medical, physiological, and/or emotional status of a patient is within a predetermined set of values relative to a predetermined set of boundary conditions.

It is a further object of this invention to disclose such a method as disclosed in any of the above, further comprising the additional steps of: (a) measuring at least one parameter related to the medical, physiological, and/or emotional status of a patient; (b) reporting said at least one parameter related to the medical, physiological, and/or emotional status of a patient; (c) limiting by a predetermined amount at least one motion of said physical therapy device to a value lower than the analogous motion of said moveable part for at least part of the time during which at least one of said parameters related to the medical, physiological, and/or emotional status of a patient is within a predetermined set of values relative to a predetermined set of boundary conditions; and (d) increasing by a predetermined amount at least one motion of said physical therapy device above the value of the analogous motion of said moveable part for at least part of the time during which at least one of said parameters related to the medical, physiological, and/or emotional status of a patient is within a predetermined set of values relative to a predetermined set of boundary conditions.

It is a further object of this invention to disclose such a method as disclosed in any of the above, further comprising the additional steps of: (a) obtaining a voice recognition unit; (b) interfacing said voice recognition unit with said means for transmitting a command signal to said physical therapy device; (c) receiving a vocal command; (d) performing at least one function chosen from the group consisting of (i) initiate a therapy session; (ii) terminate a therapy session; (iii) override said time-dependent command signals; (iv) limit at least one motion of said physical therapy device; (v) extend at least one motion of said physical therapy device; and (vi) any combination of the above.

It is a further object of this invention to disclose such a method as disclosed in any of the above, further comprising the additional step of playing music during at least a portion of the time that said physical therapy apparatus is in use.

It is a further object of this invention to disclose such a method as disclosed in any of the above, further comprising the additional step of displaying a virtual reality simulation during at least a portion of the time that said physical therapy apparatus is in use.

It is a further object of this invention to disclose such a method as disclosed in any of the above, further comprising the additional step of maintaining said patient in a predetermined position on a treatment table.

It is a further object of this invention to disclose an apparatus for treating the body of a patient or a part thereof (the treated part), by controllably maneuvering said treated part, said apparatus comprising: (a) a cradle adapted for holding said treated part stably and comfortably; and (b) a maneuverable platform upon which said cradle rests, comprising maneuvering means adapted for rotating the platform in the sagittal, coronal, horizontal planes or in any combination of the planes thereof for a predetermined duration. It is within the essence of the invention wherein said maneuver of said part is characterized by parameters selected from a predetermined set of allowed movements. Furthermore, a series of command signals are produced by the movement of said moveable portion, which, when transmitted to said physical therapy apparatus, will cause said physical therapy apparatus to undergo a series of motions substantially identical to those of said moveable portion It is a further object of this invention to disclose such an apparatus, wherein at least one of said sensors are selected from a group consisting of stereoscopic (3D) cameras adapted for motion detection, image capture equipment adapted for tracking and recording motion or any combination thereof.

It is a further object of this invention to disclose such an apparatus, additionally comprising means adapted to maintain said patient in a predetermined position on a treatment table.

It is a further object of this invention to disclose such an apparatus, wherein said treated part is chosen from the group consisting of (a) head, (b) neck, (c) any combination of the above.

It is a further object of this invention to disclose such an apparatus, wherein said treated part is maneuvered in a lobular three dimensional manner.

It is a further object of this invention to disclose such an apparatus, additionally comprising processing means for either online or offline controlling or determining said parameters.

It is a further object of this invention to disclose such an apparatus, further comprising means for presenting audiovisual entertainment during the use of said apparatus, said means for presenting audiovisual entertainment chosen from the group consisting of (a) means for playing music during the treatment, (b) means for presenting a virtual reality display.

It is a further object of this invention to disclose such an apparatus, additionally comprising detecting means and reporting means chosen from the group consisting of EMG, EKG, GSR or a combination thereof, said detecting means and reporting means adapted to obtain one or more parameters related to the medical, physiological, and/or emotional condition of said patient; said reporting means further adapted for either online or offline reporting of said condition of said patient, and said reporting means adapted to provide a report to at least one of (a) a remote module, (b) an adjacent module.

It is a further object of this invention to disclose such an apparatus, wherein said at least one detecting means is feedback interconnected with said maneuverable platform such that at least a portion of said maneuvering parameters is updated in a manner chosen from the group consisting of (a) online and (b) offline.

It is a further object of this invention to disclose a method for treating the body of a patient or a part thereof (the treated part), comprising the steps of: (a) placing said treated part on a manipulatable cradle; (b) controllably maneuvering said cradle, either in a direct or indirect manner, in the sagittal, coronal, horizontal planes or in any combination thereof for a predetermined duration. It is within the essence of the invention wherein said maneuvering is characterized by parameters selected from a predetermined set of allowed movements.

It is a further object of this invention to disclose such a method, further comprising the step of maneuvering said treated part in a lobular three dimensional manner.

It is a further object of this invention to disclose such a method, further comprising at least one step of detecting the condition of said patient or said treated part, said step of detecting performed in a manner chosen from the group consisting of (a) online and (b) offline, and said step of detecting performed either prior to or contemporaneously with step (b).

It is a further object of this invention to disclose such a method, wherein said detecting is provided by means of a method chosen from the group comprising EMG, EKG, GSR or a combination thereof.

It is a further object of this invention to disclose such a method, further comprising the additional steps of (a) interconnecting in a feedbacked manner said manipulatable cradle with said detecting means; and (b) updating at least a portion of said maneuvering parameters, in a manner chosen from the group consisting of (a) online and (b) offline, said step of updating performed either prior to or contemporaneously with step (b).

It is a further object of this invention to disclose such a method, adapted for treating at least one condition chosen from the group comprising (a) headaches, (b) migraines, (c) myofascial headaches, (d) muscular tension, (e) nervous tension, and (f) post traumatic pain.

It is a further object of this invention to disclose such a method, further adapted for treating neck pain.

It is a further object of this invention to disclose such a method, wherein said neck pain is chosen from the group consisting of (a) whiplash, (b) muscular pain, (c) cervical disc herniation/protrusion associated with neck and arm pain, (d) over-tension of the neck muscles, and (e) neck movement disorders.

It is a further object of this invention to disclose such a method, further adapted to achieve relaxation of the body parts chosen from the group consisting of head, neck and shoulders.

It is a further object of this invention to disclose such a method, further adapted to provide a treatment chosen from the group consisting of (a) improvement of neck muscle function; (b) treatment for at least one sleep disorder; (c) increasing neck muscle bulk; (d) improving ROM; and (e) rehabilitating movement of at least one affected body part following an injury.

It is a further object of this invention to disclose such a method, further comprising an additional step of providing to said patient a menu of different movement courses or cycles is provided, wherein each of said movement courses or cycles is tailored for the specific needs of patient with a particular set of symptoms.

It is a further object of this invention to disclose such a method, further comprising the additional step of allowing said cradle to move the head and neck of said patient to a predetermined target, wherein the patient's motions are controlled by said cradle.

It is a further object of this invention to disclose such a method, further comprising the additional step of directing said patient to react to the movement of said cradle by concomitant movement of said patient's neck in substantially the same direction as that of said cradle, wherein said patient actively controls his or her own motions.

It is a further object of this invention to disclose a method for decreasing the value of a patient's result according to the Visual Analog Scale/Numerical (VAS/NRS) (10-point) Rating Scale, comprising manipulating the body of said patient or part thereof in a predetermined set of allowed movements, wherein said VAS/NRS score decreases by at least 20%, when compared with a control group which has not undergone said manipulations.

It is a further object of this invention to disclose a method for increasing Functional health status SF-36 score of a patient, comprising manipulating the body of said patient or a part thereof in a predetermined set of allowed movements, wherein said SF-36 is improved by at least 10%, when compared with a control group which has not undergone said manipulations.

It is a further object of this invention to disclose a method for decreasing a patient's Neck Disability Index (NDI), comprising manipulating the body of said patient or a part thereof in a predetermined set of allowed movements, wherein said NDI decreases by at least 10% when compared with a control group which has not undergone said manipulations.

It is a further object of this invention to disclose a method for decreasing scores of at least one test selected from a group consisting of (a) Headache Impact Test (HIT) and (b) Migraine Disability Assessment Questionnaire (MIDAS), comprising a step of manipulating the body of said patient or a part thereof in a predetermined set of allowed movements, wherein said at least one test score decreases in at least one stage, when compared with a control group which has not undergone said manipulations.

It is a further object of this invention to disclose such a method, wherein said Headache Impact Test is HIT-6.

It is a further object of this invention to disclose a method for decreasing Epworth Sleepiness Scale (EPS), comprising manipulating the body of said patient or a part thereof in a predetermined set of allowed movements, wherein said EPS decreases by at least 10% when compared with a control group which has not undergone said manipulations.

It is a further object of this invention to disclose a method for increasing (Short) Musculoskeletal Function Assessment ((S)MFA), comprising manipulating the body of said patient or a part thereof in a predetermined set of allowed movements, wherein said (S)MFA score increases in at least 10% when compared with a control group which has not undergone said manipulations.

It is a further object of this invention to disclose a method for decreasing a test score for a test of a patient's ability to undertake daily activities, said test score according to a scale in which 10=no ability to undertake daily activities and 0=full ability to undertake daily activities, comprising a step of manipulating the body of said patient or a part thereof in a predetermined set of allowed movements, wherein said at test score decreases by at least 10%, when compared with a control group which has not undergone said manipulations.

It is a further object of this invention to disclose a method for increasing a patient's cervical range of motion, comprising a step of manipulating the body of said patient or a part thereof in a predetermined set of allowed movements, wherein said patient's range of motion in at least one degree of freedom of cervical motion increases by at least 10%.

It is a further object of this invention to disclose a method for increasing the SF-36 (functional health status) score of a patient, comprising a step of manipulating the body of said patient or a part thereof in a predetermined set of allowed movements, wherein said patient's SF-36 questionnaire score increases by at least 10%.

It is a further object of this invention to disclose a method for decreasing the Migraine Disability Assessment Questionnaire score (MIDAS) of a patient, comprising a step of manipulating the body of said patient or a part thereof in a predetermined set of allowed movements, wherein said patient's MIDAS decreases by at least 10%.

It is a further object of this invention to disclose a method for decreasing the Epworth Sleepiness Scale (EPS) score of a patient, comprising a step of manipulating the body of said patient or a part thereof in a predetermined set of allowed movements, wherein said patient's EPS score decreases by at least 10%.

BRIEF DESCRIPTION OF THE FIGURES

In order to understand the invention and to see how it may be implemented in practice, a plurality of embodiments is adapted to now be described, by way of non-limiting example only, with reference to the accompanying drawings, in which

FIG. 7 illustrates, not to scale, various lobular two and three dimensional maneuvers according to a set of possible embodiment of the present invention; FIG. 3 sketches the 3 planes of head and neck movement, together with the 3 axes of movement.

DETAILED DESCRIPTION OF THE PREFERRED EMBODIMENTS

In the following description, various aspects of the invention will be described. For the purposes of explanation, specific details are set forth in order to provide a thorough understanding of the invention. It will be apparent to one skilled in the art that there are other embodiments of the invention that differ in details without affecting the essential nature thereof. Therefore the invention is not limited by that which is illustrated in the figures and described in the specification, but only as indicated in the accompanying claims, with the proper scope determined only by the broadest interpretation of said claims. As used herein, the term "physical therapy device" refers to any device that performs any kind of physical manipulation on the body of an individual or a part thereof.

As used herein, the term "physical therapy session" refers to a period of time during which a physical therapy device as defined above is in operation (i.e. performing a physical manipulation on the body of an individual or part thereof.

As used herein, the term "motion of a physical therapy device" refers to the motions of said device that enable or cause manipulation of the patient's body or body part of interest during the physical therapy, and not necessarily to gross motions of the device itself. Similarly, as used herein, terms such as "increase" or "decrease" of the motion of a physical therapy device can refer to changes in the amplitude, velocity, or acceleration of the motions leading to the manipulation of the body or body part of interest. That is, when the context requires it, it is understood in what follows that the motions of the manipulated body or body part are discussed in terms of the motions of the physical therapy device that lead to such manipulations.

As used herein, the term "about" refers to a value being up to ±25% of the defined measure.

As used herein, the term "EMG sensor" refers to a surface electromyographic sensor, this being an electrical sensor adapted for measurement of compound muscle action potential, which is correlated to the degree of muscle activation.

As used herein, the term "cradle" refers to a supporting means, selected in a non-limiting manner for cradles, pillows, headrests, cushions, puffs, mattresses etc.

Figure 1A:
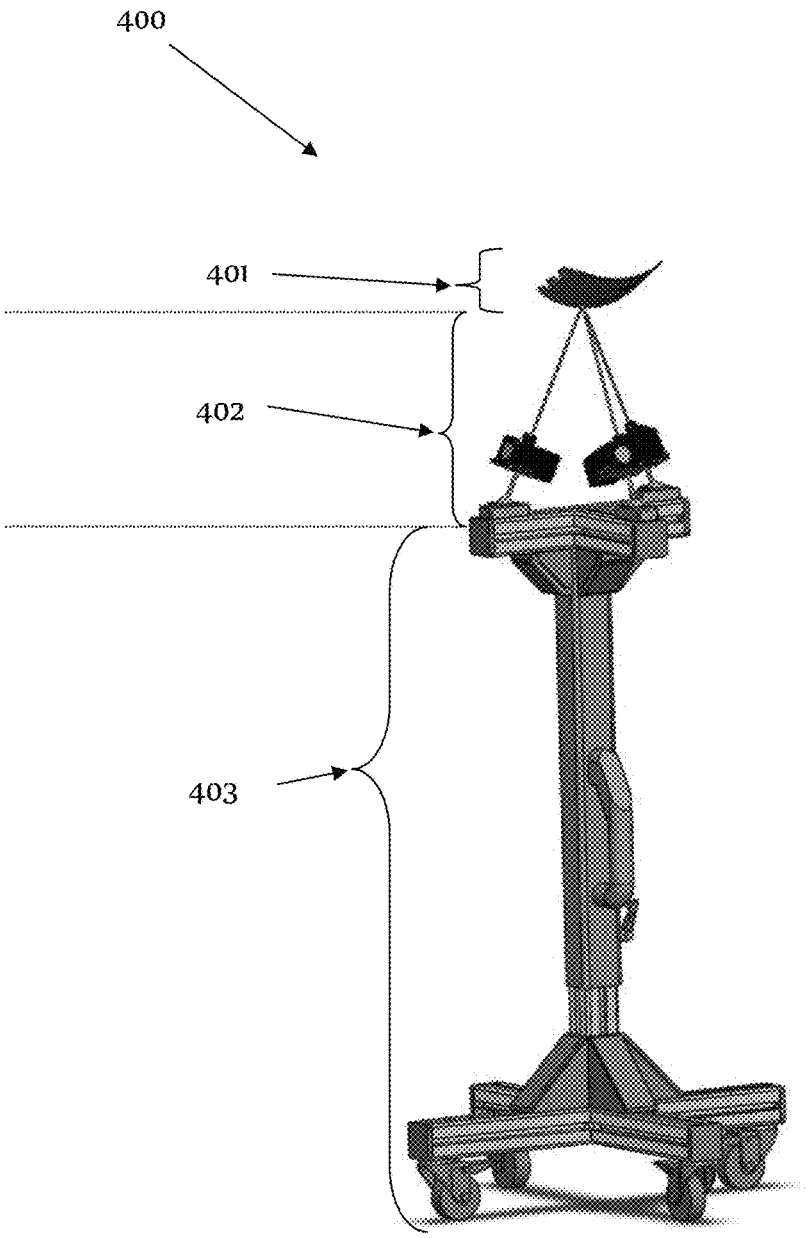
FIGS. 1*a*-1*c* is a schematic representation of a remote control device adapted for use with a device for manipulating a patient's head and neck.

Reference is now made to FIG. 1, which illustrates an embodiment of remote control device 400. In the embodiment illustrated, the remote control device is adapted for controlling a physical therapy device designed to perform manipulations of the head and/or neck of a patient. The remote control device comprises three sections: a moveable portion 401 (a glove-like element); a motion manipulator portion 402; and a base portion 403. A schematic illustration of the fully-assembled remote control device is given in FIG. 1*a*.

Figure 1B:
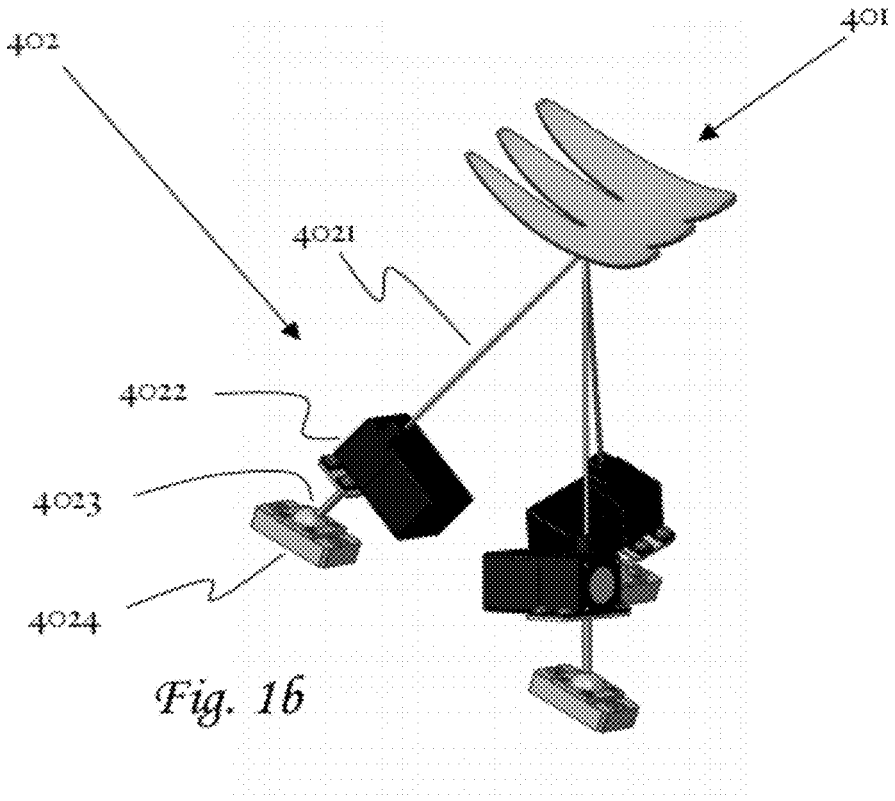

Reference is now made to FIG. 1*b*, which provides a schematic (not to scale) close-up view of moveable portion 401 and motion manipulator portion 402. Moveable portion 401 is a glove-like device into which the caregiver inserts his/her hands, and upon which the patient's head and neck lie. The motion manipulator portion comprises three individual manipulator units in order to provide independent motion along each of the x, y, and z axes. Each motion manipulator unit comprises a rod 4021 that is attached to, and physically provides motion to, moveable portion 401. The rod is attached to a position potentiometer 4022 that measures the position of and controls the motion of the particular rod to which it is connected. The details of motion control and measurement are given below. The position potentiometer is attached to a ball joint 4023, allowing free movement in any direction. The ball joint rests on ball joint base 4024.

Figure 1C:
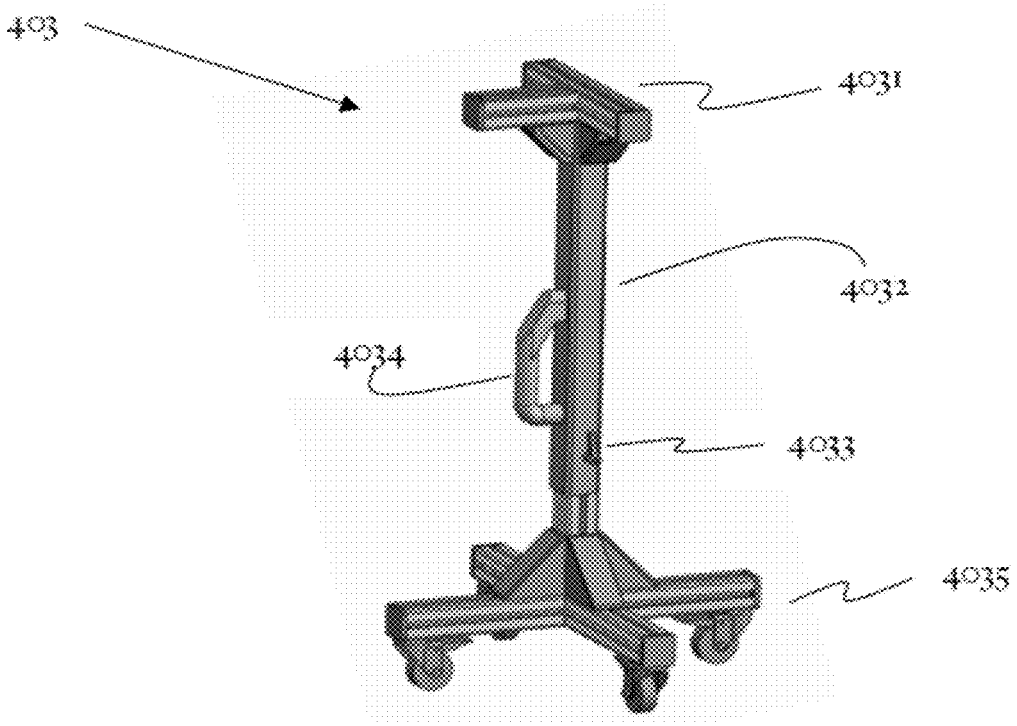

Reference is now made to FIG. 1*c*, which provides a schematic (not to scale) close-up view of base portion 403. The base comprises an upper rest 4031, upon which motion manipulator portion 402 rests. Each of the ball joint bases 4024 is firmly affixed to upper rest 4031. Base portion 403 further comprises a slider 4032. The slider is adapted to raise or lower the moveable portion and motion manipulator portion to the desired height appropriate to a given individual being treated. Slider lock 4033 enables the user to fix the height of the moveable portion once the proper height has been established. The base portion further comprises a handle 4034, which is adapted to aid the user in manipulating the gross position of the entire remote control unit. Base portion 403 rests on a base 4035. Base 4035 further comprises a plurality of lockable casters. In a preferred embodiment, the lockable casters are of a type further comprising a swivel, thus enabling easy positioning of the entire remote control unit.

Figure 2:
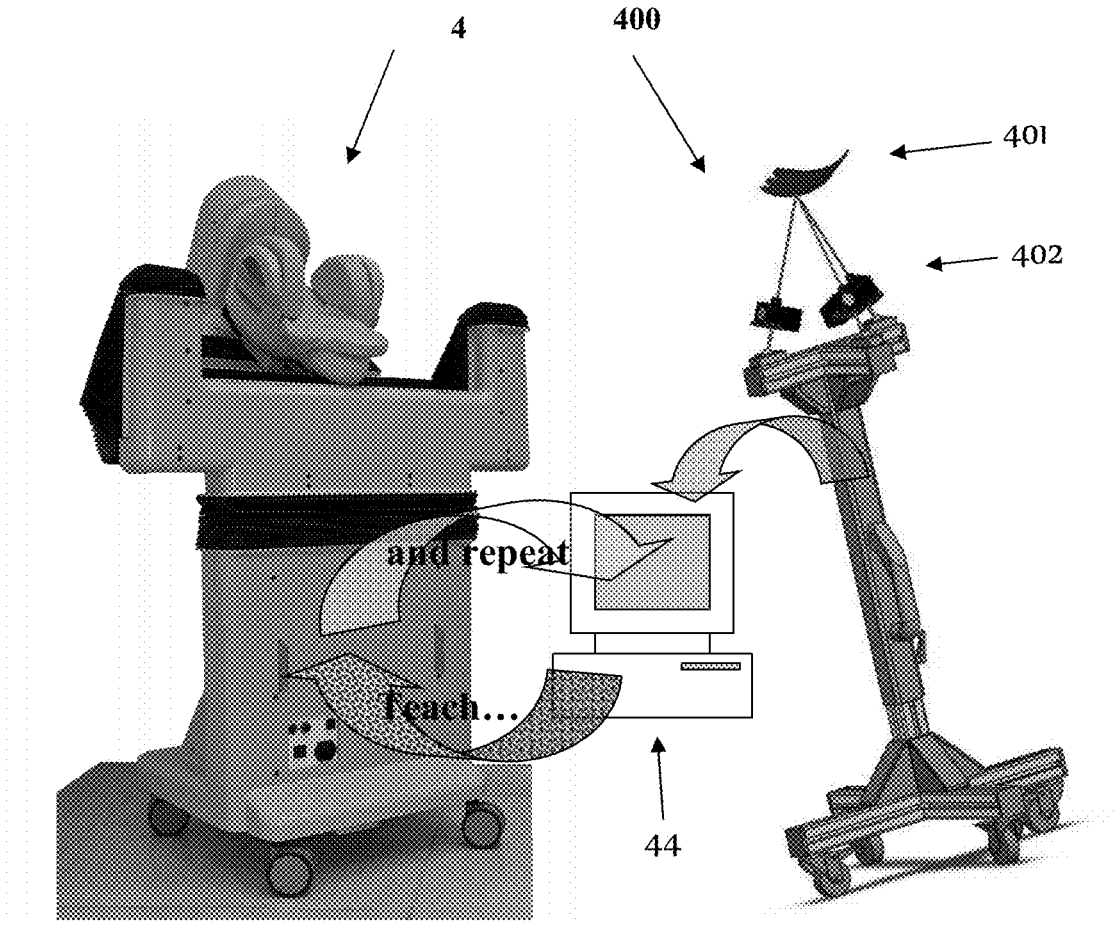
FIG. 2 shows the remote control device of FIG. 1 in relation to the physical therapy apparatus.
Figure 3:
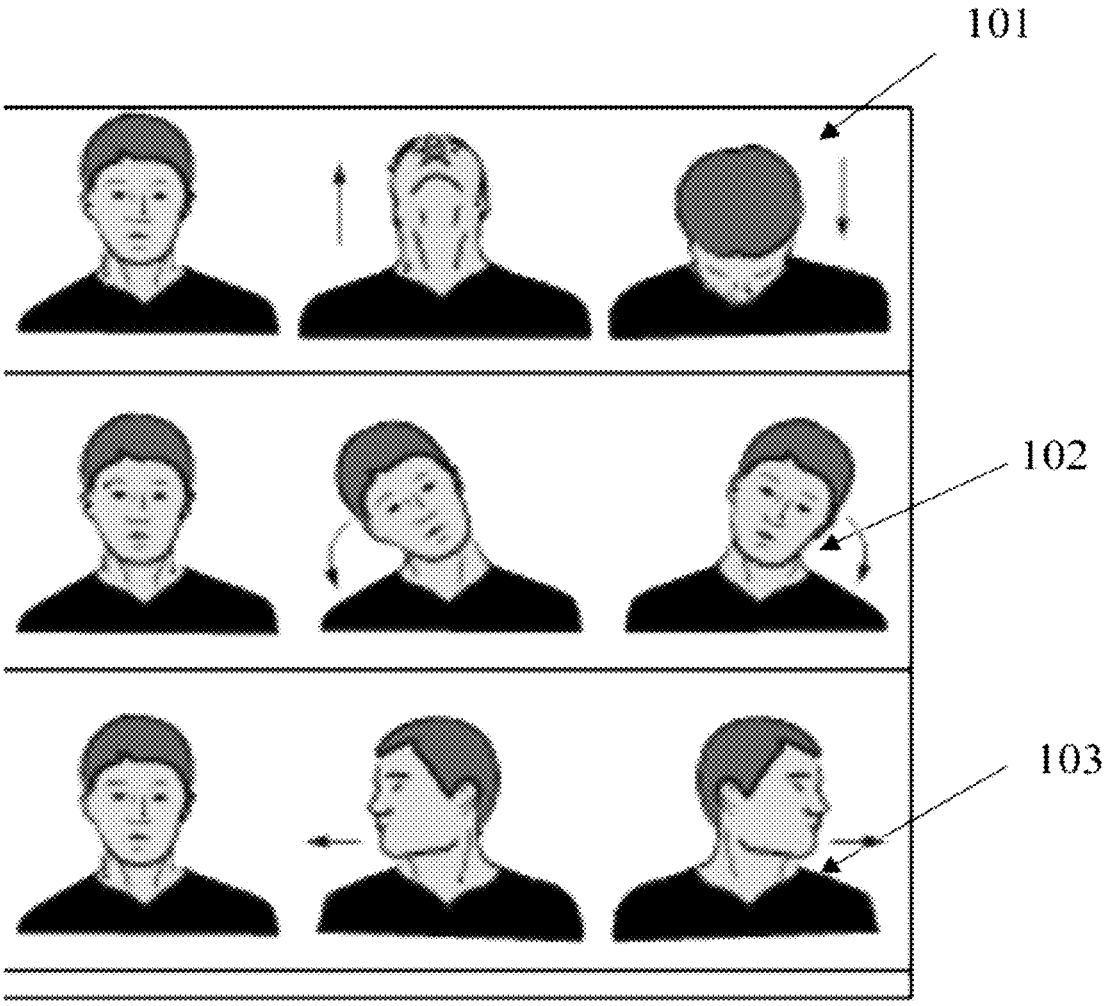
FIG. 3 schematically presents various possible rotations of the head about the 101 sagittal, 102 coronal, and 103 horizontal planes.
Figure 4A:
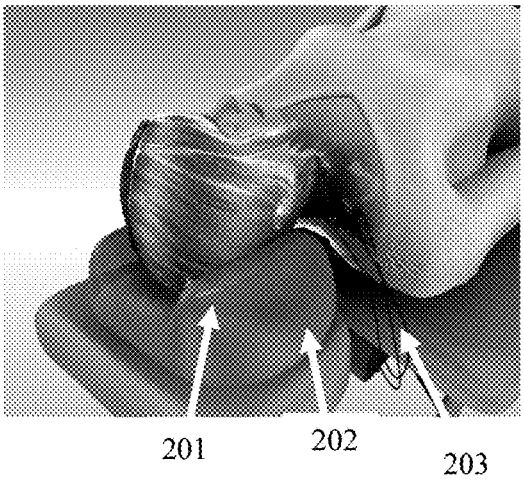
FIG. 4*a* illustrates an embodiment of the invention including cradle 201, partially filled with viscous fluid, platform 202 supporting the cradle and moved by motors in three planes, and EMG electrodes 203, used for research purposes, to determine the optimal course of treatment.
Figure 4B:
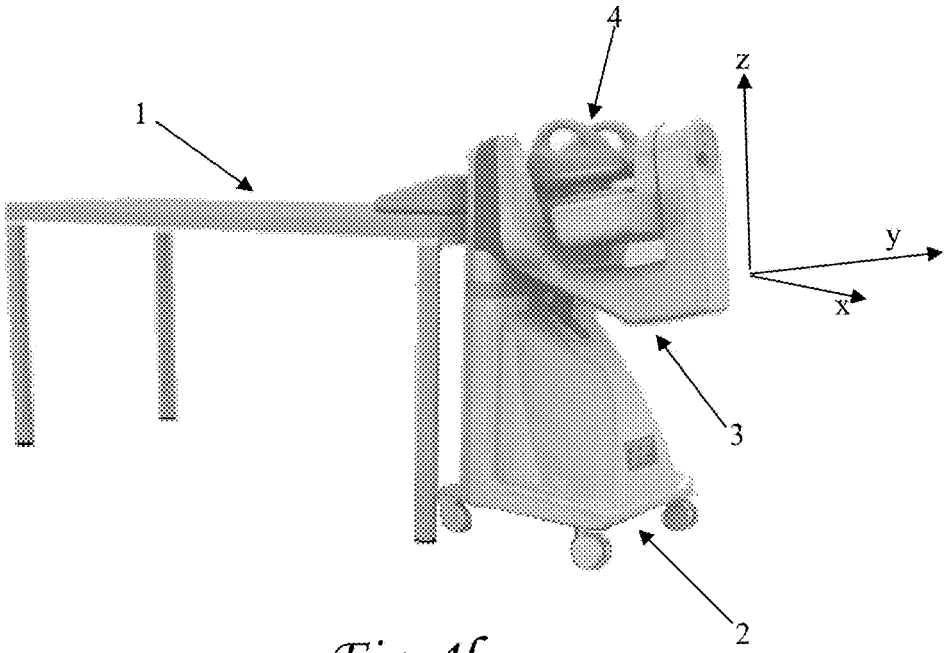
FIG. 4*b* illustrates a device according to one embodiment of the invention, wherein 1, 2, 3 and 4 are denoted for the standard treatment table (upon which the person undergoing treatment rests on), portable base, motion system and cradle members of the device, respectively.

This apparatus is connected to the physical therapy device itself. Reference is now made to FIG. 2, which illustrates this embodiment of the remote control device along with the physical therapy device 4 that it controls. The moveable portion 401 is attached to one end of the motion manipulator portion 402. The attachment is done by any means known in the art that allows the moveable portion freedom of motion relative to the motion manipulator portion. In a preferred embodiment, the moveable portion 401 retains three rotational degrees of freedom (i.e. freedom to rotate independently in the sagittal, coronal, and horizontal planes; these planes of motion are illustrated in FIG. 3) relative to the motion manipulator portion 402. In a second preferred embodiment, the moveable portion 401 retains these three rotational degrees of freedom along with three linear degrees of freedom (i.e. freedom to move independently along the axis parallel to the motion manipulator 402 part's primary axis of the motion manipulator and the two axes in the plane perpendicular to the motion manipulator 402 part's primary axis).

Motion manipulator portion 402 further comprises means for allowing the free motion of the moveable portion 401 as described above. Such means are well-known to those skilled in the art. In addition, the motion manipulator portion comprises a plurality of sensors for determining the motions of the moveable portion relative to primary axis of the motion manipulator portion. These sensors may be of any type known in the art (e.g. linear position sensors) that is or can be adapted for transmitting in real time measurements of the motions of the moveable portion, in particular, the direction of motion, velocity, and acceleration along each of the degrees of freedom. The sensors are adapted to convert these measurements into time-dependent output signals, with the magnitudes signals being proportional to the magnitudes of the measured motions. Each of these signals is transmitted (grey arrow) in real time to a transceiver.

It is a further object of this invention to disclose such a device, wherein at least one of said sensors are selected from a group consisting of stereoscopic (3D) cameras adapted for motion detection, image capture equipment adapted for tracking and recording motion or any combination thereof.

In a preferred embodiment, this transceiver is a computer board (pcb) located within a computer 44. Such boards, adapted for recording the time-dependent output of motion or position sensors, are well-known in the art, and any commercially available board of this type that has a sufficient number of inputs to be able to measure independently all of the signals output by the various sensors may be used. The transceiver then transmits the signals that it receives from the sensors to a storage unit. In preferred embodiments, this storage unit is any digital storage means convenient to the operator (e.g. the hard disk of a computer, CD-ROM, etc.), and in embodiments in which the output of the sensors is an analog signal, the analog-to-digital conversion is done by the transceiver. The control of the physical therapy device can then be done in a variety of fashions. In preferred embodiments, the signals are retrieved from storage and then transmitted (textured arrow) as a time-dependent "command signal" to the physical therapy device; this transmission can be done by the same transceiver that is used to receive the time-dependent output signals from the sensors (including digital-to-analog conversion if necessary). The command signal is of an appropriate magnitude and duration that when it is received by the controllers of the physical therapy device, the device will reproduce the magnitudes, durations, velocities, and accelerations of the original motions of the moveable portion. The command signal is then transmitted to the physical therapy device. Thus, a series of manipulations of the moveable portion of the remote control device leads to identical motions of the physical therapy device for manipulation of the body or a part thereof of a patient. All of the means of signal transmission and reception can be any of those that are known in the art, whether hardwired (e.g. electrical signals) or wireless.

It is a further object of this invention to disclose such a device, wherein at least one of said sensors are selected from a group consisting of stereoscopic (3D) cameras adapted for motion detection, image capture equipment adapted for tracking and recording motion or any combination thereof.

In a preferred embodiment of the invention, a computer 44 is provided that includes the control hardware and storage media described above along with appropriate software to allow monitoring and control of the apparatus and device. Such software allows the operator to design or alter the protocol of motions of the physical therapy device by direct input of commands that are then translated into appropriate command signals.

Furthermore, since the time-dependent signals are stored using a digital storage medium, a separate individualized protocol can be stored and then recalled for each patient. In other words, each patient is treated with a specific therapy such that each therapy will be suited to said specific patient according to different parameters characterizing said specific patient. said parameters can be any combination of "allowed movements" as defined in Table 1 below.

For many physical therapy applications, the manipulations of the patient's body are done repetitively (white arrow). The software allows the operator to fix a specific number of repetitions that are to be used in a particular physical therapy session, or to allow an indefinite number of repetitions (e.g. until a STOP signal is received). In addition, the caregiver can change the velocity and amplitude of the recorded session, using a "coefficient" function, to increase or decrease the speed or ROM of the treatment session.

Additional embodiments allow for feedback control of the physical therapy session. In these embodiments, the device additionally includes a means for measuring and reporting at least one parameter related to the medical, physiological, and/or emotional status of a patient, chosen from the many commercially available devices. Typical non-limiting examples of these parameters include EMG, ROM, blood pressure, EKG, and galvanic skin response (GSR). The measured parameters are reported to at least one module that can be either adjacent to or remote from the physical therapy apparatus. The feedback system in embodiments that include it includes an interface between the reporting means and the means for transmitting command signals to the physical therapy device. A set of boundary conditions of the parameter or parameters of interest is defined. When the measured parameter is reported to be outside the boundary conditions, at least one motion of the physical therapy device are reduced from those defined by the protocol described above; the amount of such reduction is predefined by the operator either prior to or during the physical therapy session. Optionally, a set of boundary conditions can be set such that when the parameter or parameters of interest lie within the boundary conditions, at least one motion of the physical therapy device is increased by a predetermined amount from that defined by the original protocol as defined above.

As a non-limiting example, galvanic skin response (GSR), heart rate and blood pressure can be used as indications of the level of stress of the patient, and the boundary conditions set as a predefined maximum GSR, heart rate and maximum blood pressure such that a stress condition is defined when one of them exceeds the predefined maximum (or when both exceed the predefined maximum simultaneously). When a stress condition is determined, the initial protocol is overridden, and at least one motion of the physical therapy device lowered by a predetermined amount (either an absolute or a relative amount) until the GSR, heart rate and/or blood pressure return to values below the maximum. The boundary conditions need not be an upper limit; they can be defined as a lower limit, as a range, or to exclude a range, depending on the parameter used and the therapeutic goal.

In an additional embodiment of the invention, the device includes a voice recognition unit. Such units are well-known in the art, and any appropriate commercially available device can be used. The voice recognition unit is programmed to recognize at least one vocal command (e.g. a specific word such as "STOP," any vocalization above a certain decibel level, etc.). The voice recognition unit is interfaced with the means for transmitting the command signal such that a function of the device is performed on receipt of a vocal command. A non-limiting list of typical functions includes: initiating a physical therapy session; stopping a physical therapy session; overriding the command signals (e.g. via a command to increase or decrease the motion of the physical therapy apparatus); limiting at least one motion of the physical therapy device; and extending at least one motion of the physical therapy device.

In alternative embodiments of the invention, the protocol for the motions of the physical therapy device that lead to manipulation of the body or body part of the patient is obtained by the use of a device that can determine in real time the changes in its position and orientation. The patient is physically manipulated (either away from the physical therapy device or in contact with it) and the motions of the patient's body or body part are recorded. These motions are transmitted to the remote control device, and converted to command signals such that the motions of the physical therapy device will mimic those of the motions of the patient during the physical manipulation. One means for accomplishing this procedure is the use of a camera system designed to measure and report in real time the 3D position and orientation of the patient's body or body part. Said orientation is provided by means of image processing.

In alternative embodiments of the invention, the protocol for the motions of the physical therapy device that lead to manipulation of the body or body part of the patient is obtained by direct manipulation of the physical therapy apparatus rather than by use of a remote control device. In these embodiments, the physical therapy apparatus includes a plurality of sensors of types analogous to those discussed above for the remote control system. The patient is placed in contact with the physical therapy apparatus, and the appropriate manipulations are performed manually. The sensors measure the motions in a manner analogous to that of the measurements of the moveable portion of the remote control device described above. The sensors embedded within the physical therapy apparatus produce output signals that are proportional to the motions of the physical therapy device itself. These output signals are then transmitted to the transceiver, and the remainder of the method proceeds as in the embodiments comprising a remote control device as described above.

It is a further object of this invention to disclose such a device, wherein at least one of said sensors are selected from a group consisting of stereoscopic (3D) cameras adapted for motion detection, image capture equipment adapted for tracking and recording motion or any combination thereof.

A specific non-limiting example of a physical therapy apparatus that can be adapted for use with the invention herein disclosed is a physical therapy apparatus for treatment of the head and/or neck.

In essence the proposed device is a computerized neck mobilization device, which is controlled by muscle feedback. It supports natural neck lordosis. The dynamic cradle is a multi-layered pillow, which is filled with adjustable flexible/liquid/viscous material. The person undergoing treatment rests his or her head within a recess in the cradle while lying down, either prone or supine. In the course of the treatment the head is caused to perform a 3D oscillatory movement at a very slow velocity (e.g., 0.3-3° $s^{-1}$) by means of motors adapted to move a platform, on which the cradle rests, in three axes. This slow movement is adapted to lengthen and relax over-contracted neck muscles. It is adapted to gradually abolish abnormal neck muscle contraction patterns.

A computer controls the movement of the motorized platform upon which the cradle rests.

In one embodiment of the invention this computer provides movement of the head described in the following table, in which the angle of the head is defined by the vector of movement angles in the sagittal, coronal, and horizontal planes, denoted (S, C, H), where S is the sagittal angle in degrees, C is the coronal angle in degrees, and H is the horizontal angle in degrees, and where in all planes 0° is the position of the un-tilted head:

TABLE 1

Basic Movement Cycle and Allowable Movements

| Step | Allowable Movement | Start Angle | End Angle |
|---|---|---|---|
| 1. | Sagittal flexion | (0°, 0°, 0°) | (Up to 70°, 0°, 0°) |
| 2. | Sagittal return | (Up to 70°, 0°, 0°) | (0°, 0°, 0°) |
| 3. | Coronal tilt right | (0°, 0°, 0°) | (0°, Up to 45°, 0°) |
| 4. | Coronal return right | (0°, Up to 45°, 0°) | (0°, 0°, 0°) |
| 5. | Coronal tilt left | (0°, 0°, 0°) | (0°, Up to −45°, 0°) |
| 6. | Coronal return left | (0°, Up to −45°, 0°) | (0°, 0°, 0°) |
| 7. | Horizontal rotation right | (0°, 0°, 0°) | (0°, 0°, Up to 60°) |
| 8. | Horizontal return right | (0°, 0°, Up to 60°) | (0°, 0°, 0°) |
| 9. | Horizontal rotation left | (0°, 0°, 0°) | (0°, 0°, Up to −60°) |
| 10. | Horizontal return left | (0°, 0°, Up to −60°) | (0°, 0°, 0°) |

It is in the scope of the invention wherein the patient's body or an organ thereof is manipulated in a set of (i) allowed movement, (ii) start angles, and (iii) end angles; Sagittal flexion, (0°, 0°, 0°), (Up to 70°, 0°, 0°), respectively; Sagittal return (Up to 70°, 0°, 0°), (0°, 0°, 0°; Coronal tilt right, (0°, 0°, 0°), (0°, Up to 45°), 0°; Coronal return right, (0°, Up to 45°, 0°), (0°, 0°, 0°); Coronal tilt left), (0°, 0°, 0°), (0°, Up to −45°, 0°); Coronal return left, (0°, Up to −45°, 0°), (0°, 0°, 0°); Horizontal rotation right, (0°, 0°, 0°), (0°, 0°, Up to 60°); Horizontal return right, (0°, 0°, Up to 60°), (0°, 0°, 0°); Horizontal rotation left, (0°, 0°, 0°), (0°, 0°, Up to −60°); Horizontal return left, (0°, 0°, Up to −60°), (0°, 0°, 0°, respectively, refers in the present invention as "allowed movements".

In 'feedback mode' the computer receives feedback signals from electromyography (EMG) sensors on the patient's shoulder girdle neck and/or facial muscles, to optimize a personal unique treatment of the head and neck in three dimensional space and time. The biofeedback uses EMG, involving electrodes which monitor the compound active muscles action potential.

The pattern movement optimization of is established through a mathematical algorithm. Once the following parameters: 3D diverse positions, motion sequences, frequencies and movement timing are optimized in all three planes; this data is stored for further treatments.

Due to the technology used, the patient undergoes a relaxing "zero gravity" floating experience, which leads to profound muscle relaxation, including relaxation of neck muscles as well as facial and mastication muscles.

This dynamic cradle is useful for the treatment of pain especially head and neck pain syndromes such as migraine, and other headaches: tension type, post traumatic, cervicogenic, and myofascial headache, as well as neck pain, such as whiplash injury and muscle over-contraction.

Moreover, this dynamic cradle is useful for the treatment of ROM dysfunctions, by improving patient's ROM and neck muscle flexibility; rehabilitation and relaxation of shoulder and neck muscles over-contraction, e.g., after sport activity and/or other injuries, and whole body relaxation. Besides, while opposing the cradle movement one can increase his or her muscle bulk & strength.

In one embodiment of the invention, vestibular physical therapy is provided for treatment of patients with Benign Paroxysmal Positional Vertigo.

In addition, this dynamic cradle is useful for treating sleep disorders; and cervical disc-herniation/protrusion associated with neck and arm pain and osteoarthritis coupled with arm pain. According to one embodiment of the invention, it produces a kneading action similar, but markedly superior to that achieved by physical therapist neck mobilization.

According to yet another preferred embodiment of the present invention, a cradle is provided that conforms to the shape of the human head, neck and shoulders. The cradle rests upon a platform, which in turn may be moved in three dimensions by a plurality of motors. These motors are controlled by a computer actuating electronics adapted to do so.

In another embodiment of the invention a series of electromyographic sensors are used to provide feedback to the computer algorithm controlling the cradle's movements. By means of this feedback, movement of the motorized platform is optimized in order to provide the maximum level of muscle relaxation as indicated by the electromyographic signal.

It is a further object of this invention to disclose such a device, wherein at least one of said sensors are selected from a group consisting of stereoscopic (3D) cameras adapted for motion detection, image capture equipment adapted for tracking and recording motion or any combination thereof.

In another preferred embodiment of the invention, the optimal 3D diverse positions, motion sequences, frequencies and timing information gleaned from each individual feedback and saved by the computer program for future use.

In another embodiment of the invention, GSR and EKG signals are also used as feedback signals to inform operation of the computer algorithm, and achieve relaxation parameters of the whole body, and not only the treated areas.

In another embodiment of the invention, an additional supporting cradle is provided for neck lordosis, which may be separately adjustable.

In another preferred embodiment, the head is contained in a depression of at least 10 by 10 centimeters, such that in motions of rotation, flexion and lateral bending or tilting, the head is adapted to not slip from its place and the motion due to a given movement is adapted to therefore be predictable and repeatable.

In another preferred embodiment the platform movement-frequency is adapted to be between about 0.03 Hertz to about 0.2 Hertz.

In another preferred embodiment, the head tilt angle is adapted to be fixed to an accuracy of 1 degree.

In another embodiment of the invention a Faraday cage is adapted to be provided around the motor to eliminate any interference between the motor and the electromyographic sensors.

In another embodiment of the invention the user or operator is able to limit the head lifting/manipulating angle by means of an external switch.

In another preferred embodiment a preliminary test program is performed on the subject, to determine the maximum motion angle at each plane (See table 1) and any of the three planes combined motions. The preliminary test mode allows the optimization of safe and optimal treatment plan.

In another preferred embodiment a menu of different movement courses or cycles is available, each tailored to deal most effectively with a different type of patient.

In another preferred embodiment each plane is capable of independent activation.

In additional embodiments of the invention, a menu of different movement courses or cycles is provided, wherein each movement course or cycle is tailored for the specific needs of patients with a particular set of symptoms. In one of these embodiments, the patient is asked to fully relax and allow the device to move the head and neck to the predestined target. In this embodiment, the patient is passive.

In another embodiment comprising such a menu, the patient is asked to react to the device's movement by concomitant precise movement of his neck in the same direction. In this embodiment, the patient is active, and the device provides the opportunity for the execution of different exercises. This type of utilization will augment proprioceptive mechanisms, increase the neck muscle gross motor strength, and restore proper neck posture and muscle activation balance.

In another embodiment, the upper body may be raised by a further part of the cradle to between about 15 and about 20 degrees.

In another embodiment of the invention, music is played during the treatment.

In another embodiment of the invention, either 2D or 3D virtual reality is played or displayed during at least portions of the treatment.

In another embodiment of the invention, the cradle may be heated or cooled.

In another embodiment of the invention, the platform upon which the cradle rests is attached to the bed upon which the person undergoing treatment rests.

Figure 5:
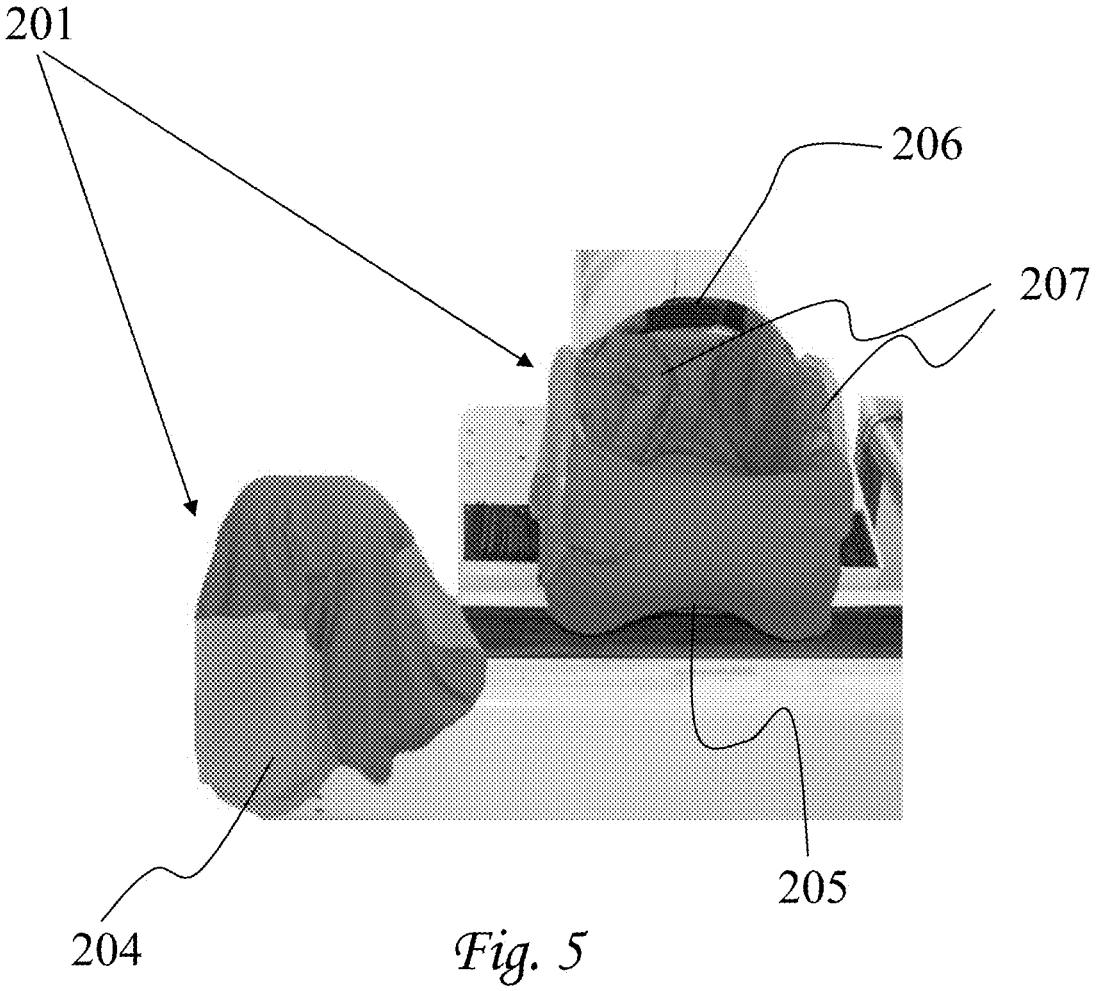
FIG. 5 illustrates cradle 201 according to one embodiment of the present invention.
Figure 6:
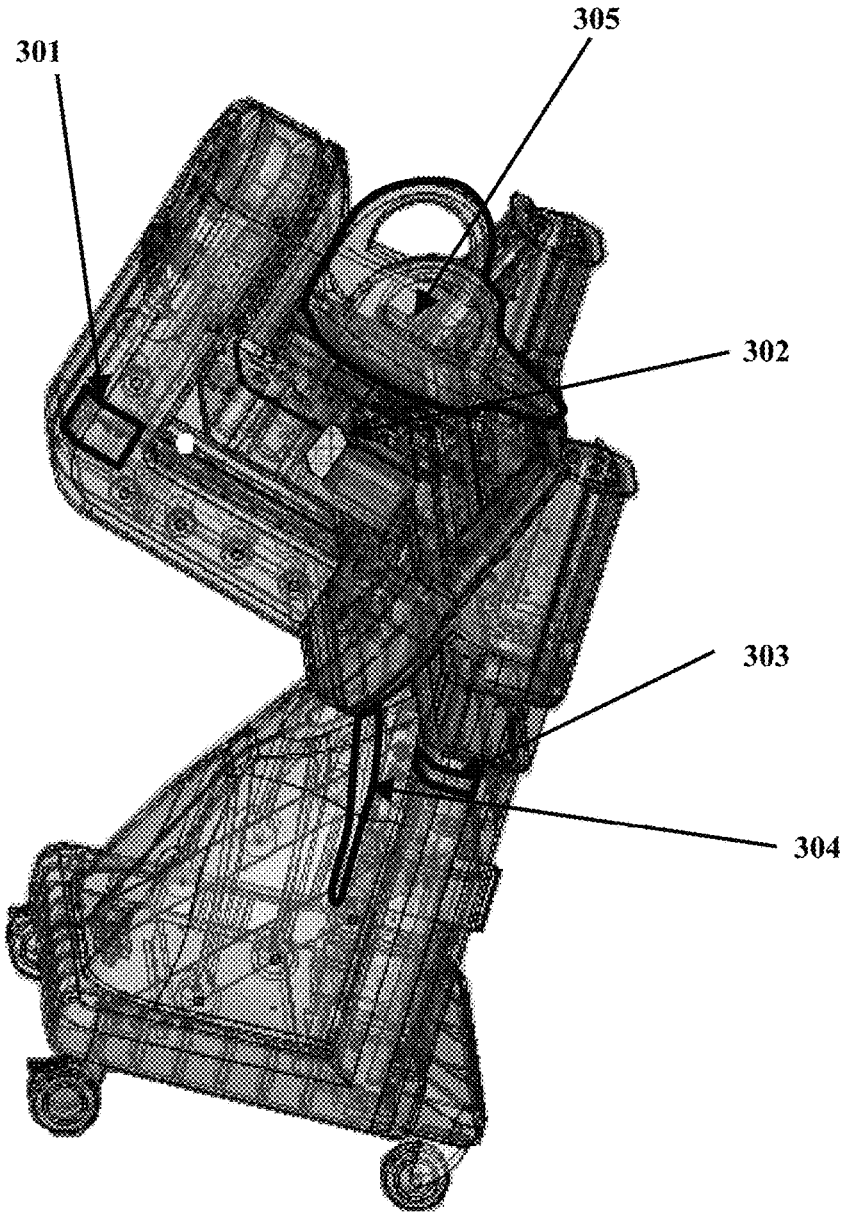
FIG. 6 schematically illustrates an embodiment of the invention showing the two motors 301 (Horizontal) and 302 (Coronal) and two linear actuators 303, and 304 (Sagittal) which move the Cradle 305, in the three planes.

Reference is now made to FIG. 5, which illustrates one embodiment of cradle 201. A cradle cover 204, constructed from flexible cloth, is fixed over the cradle. The neck of the patient rests on cervical rest 205. The cervical rest includes an elastic strap and is filled with small spheres of polystyrene or a similar plastic in order to maximize the contact area between the patient's body and the cradle, as well as to maximize the patient's comfort. Cradle 201 further comprises an adjustable head strip 206. Head strip 206 is affixed to the patient's head, and is adjustable to match the size of the patient's head. In the embodiment illustrated, the cradle further comprises a plurality of width pockets 207 adapted to adjust the cradle to the width of the patient's head. In some embodiments of the invention, the at least one of the width pockets contains at least one oval pillow. As with the cervical rest, the head strip and width pockets are designed to maximize the contact between the patient's body and cradle 201 in order to maximize the patient's comfort for a better treatment experience.

The term "SF-36" refers to the commercially available survey used to determine health status in the Medical Outcomes Study The SF-36 was designed for use in clinical practice and research, health policy evaluations, and general population surveys. The SF-36 includes one multi-item scale that assesses eight health concepts: 1) limitations in physical activities because of health problems; 2) limitations in social activities because of physical or emotional problems; 3) limitations in usual role activities because of physical health problems; 4) bodily pain; 5) general mental health (psychological distress and well-being); 6) limitations in usual role activities because of emotional problems; 7) vitality (energy and fatigue); and 8) general health perceptions. The survey was constructed for self-administration by persons 18 years of age and older, and for administration by a trained interviewer in person or by telephone. The content and features of the SF-36 are compared with the 20-item Medical Outcomes Study short-form.

The term "Headache Impact Test (HIT)" refers to a commercially available tool used to measure the impact headaches have on the ability to function on the job, at school, at home and in social situations. The patient's score shows the effect that headaches have on normal daily life and on the ability to function. HIT was developed by an international team of headache experts from neurology and primary care medicine in collaboration with the psychometricians who developed the SF-36 health assessment tool. The term "HIT-6" refers to a short-form version of the HIT, using just six items to capture the effect of headache and its treatment on an individual's functional status and well-being. HIT-6 is useful both for screening and for monitoring change in disease impact.

The term "Migraine Disability Assessment Questionnaire (MIDAS)" refers to a commercially available questionnaire that measures headache-related disability simply and easily by counting the number of days of lost and limited activity due to migraine. Activities are classed into three areas: (1) Paid work and education (school / college); (2) Household work (unpaid work such as housework, shopping and caring for children and others); (3) Family, social and leisure activities. MIDAS was developed to improve migraine care by helping physicians to identify sufferers most severely affected by their migraine and, therefore, most in need of care. The MIDAS approach increases the likelihood of patients receiving the right treatment, the first time they visit their physician about migraine.

The term "Visual Analog Scale / Numerical Rating Scale (VAS/NRS)" refers to a scale that helps patients describe their pain. The pain scale is commonly used to describe the intensity of the pain or how much pain the patient is feeling. On the numerical rating scale, the person is asked to identify how much pain they are having by choosing a number from 0 (no pain) to 10 (the worst pain imaginable). The visual analog scale is a straight line with the left end of the line representing no pain and the right end of the line representing the worst pain. Patients are asked to mark on the line where they think their pain is.

The term "(Short) Musculoskeletal Function Assessment ((S)MFA)" refers to an assessment for evaluating the health status of patients with musculoskeletal disorders of the extremities, including patients with fractures and soft tissue injuries, repetitive motion disorders, osteoarthritis or rheumatoid arthritis, see for example http://www.ortho.umn.edu/img/assets/12487/instruc.doc. It describes patient functioning, assesses outcomes of surgical interventions and clinical trials, and monitors patients' functional status over time.

The term "Range of motion (ROM)" refers to a measurement of the achievable distance between the flexed position and the extended position of a particular joint or muscle group, see for example in http://en.wikipedia.org/wiki/Range$_{13}$ of $_{13}$ motion. The act of attempting to increase this distance through therapeutic exercises (range of motion therapy - stretching from flexion to extension for physiological gain) is also sometimes called range of motion. It is in the scope of the invention wherein success is recorded by improving of 10% in range of motion. Such an improvement is recorded, e.g., by factorizing the five main movements: Sagittal plane, Horizontal plane (left and right), and Coronal (left and right) plane.

The term "Neck Disability Index (NDI)" refers to a questionnaire that assesses neck pain complaints. It is designed to enable the understanding of how much the neck pain has affected the ability to manage everyday activities.

The term "Epworth Sleepiness Scale (EPS)" refers to a scale that is used to determine the level of daytime sleepiness. A score of 10 or more is considered sleepy. A score of 18 or more is very sleepy. A score of 10 or more on this test indicates a failure to obtain adequate sleep, a need to improve sleep hygiene and/or a need to see a sleep specialist.

Figure 7A:
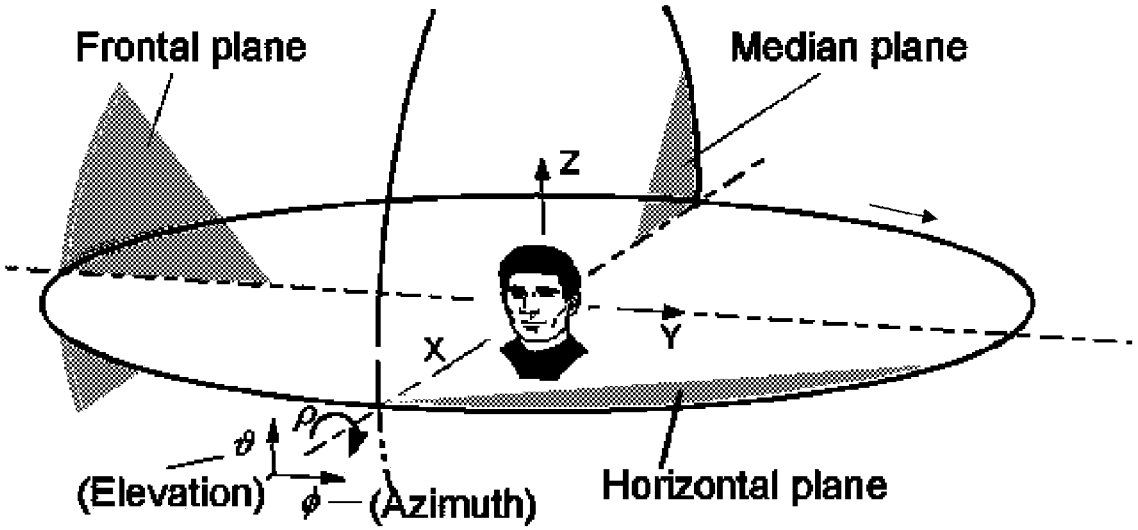
FIG. 7*a* illustrates a typical physiotherapy maneuver, 3D octet-like course.
Figure 7B:
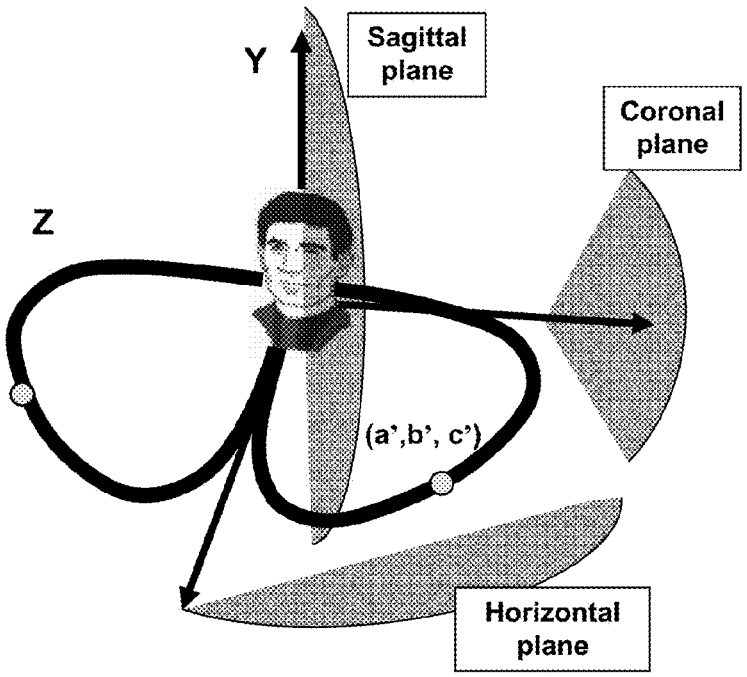
FIGS. 7*b* to 7*f* represent various sets of various maneuvers made by a plurality of allowed movements of the head and neck of the present invention.
Figure 7C:
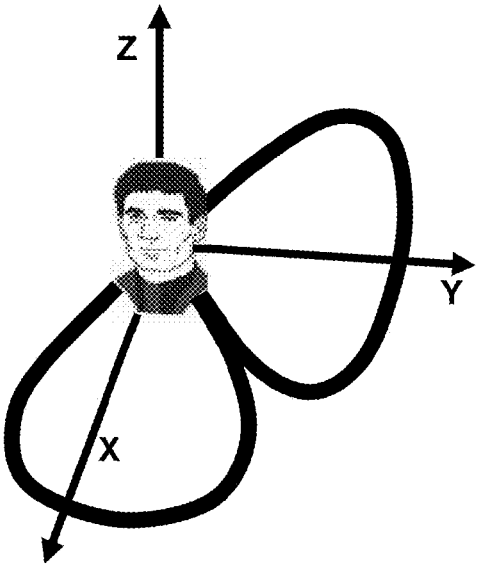
Figure 7D:
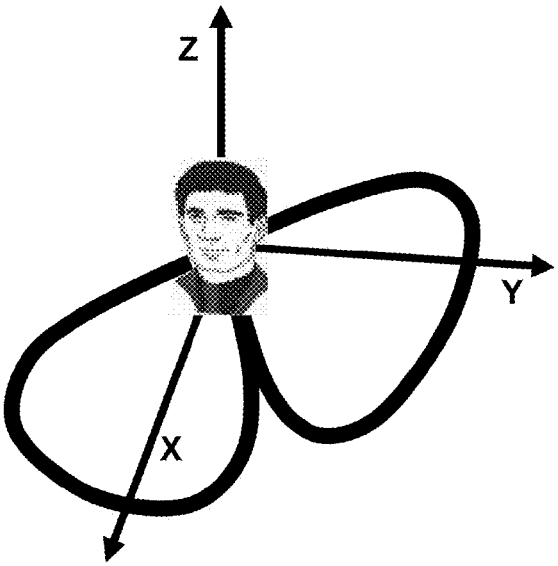
Figure 7E:
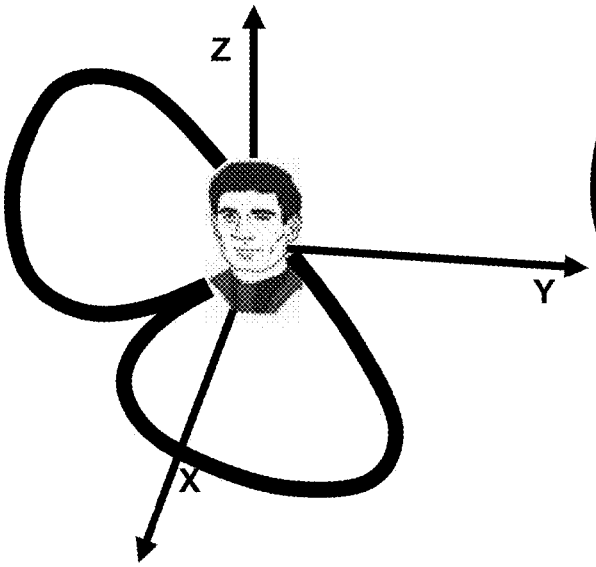
Figure 7F:
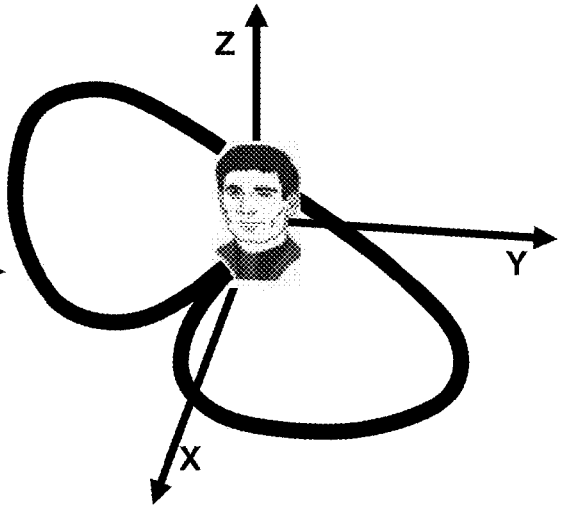

Reference is now made to FIGS. 7*a* to 7*f*, illustrating, not to scale, the direction in which the treated organ is maneuvered. FIG. 7*a* illustrates an even circular track (here, a clockwise direction). This maneuver is provided in a two dimensional and/or a three dimensional manner here a loop-like continuous movement along the horizontal plane. FIG. 7*b* depicts a figure 8-like track, here, along a counter-clockwise direction in the horizontal plane. FIGS. 7*c* - 7*f* depict similar figure 8-like continuous movement along various planes. It is acknowledged in this respect that uneven figure 8-like (with one extended lobe) continuous movements along all Sagittal, Horizontal, and Coronal planes are possible.

This 2D and/or 3D maneuver is provided in a continuous or interrupted manner, in a spontaneous, feedbacked and/or predetermined manner. It is in the scope of the invention wherein the aforesaid 3D movement is provided with six degrees of freedom (DFs), especially wherein the motion is characterized by a continuous passive motion in a 6-DFs lobular maneuver.

Figure 8A:
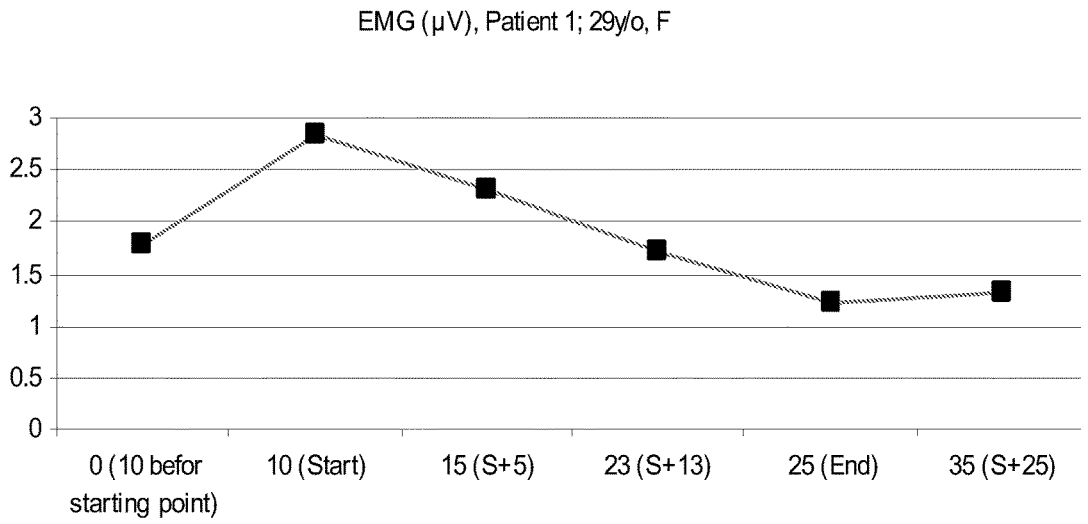
FIG. 8 illustrates EMG results in healthy and sick patients, respectively, before, during and after treatment by the device and methods of the invention.
Figure 8B:
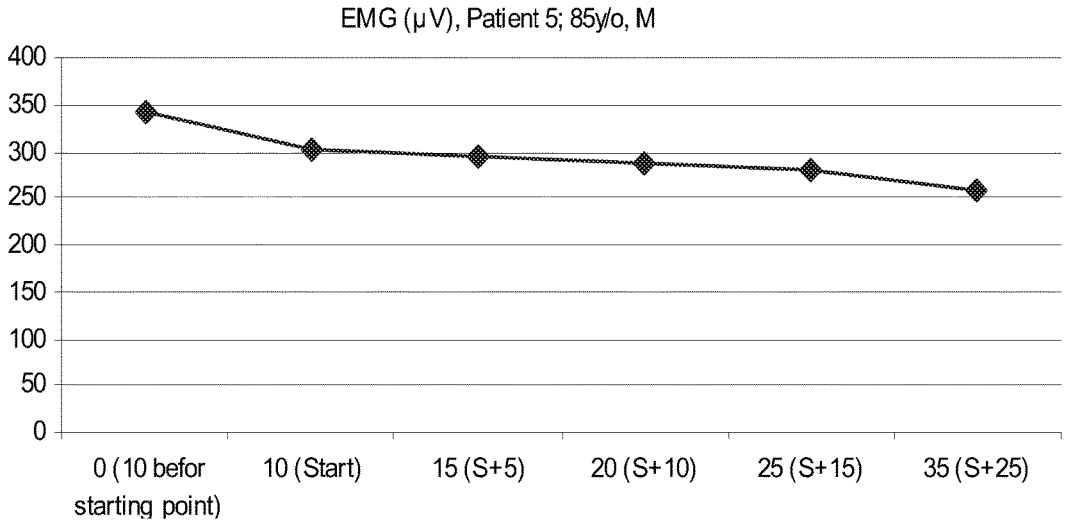

Reference is now made to FIGS. 8*a* and 8*b*, presenting examples of EMG results in a control patient (a healthy female aged 30 years) and an 85 year old male patient with tension type headaches (TTH), respectively. EMG values increase at the initial 10 minutes of resting the head on a cradle (see member 201 above). By actuating the maneuverable platform upon which the cradle rests, by maneuvering the head of the patient in the sagittal plane in a set of allowed movements, EMG values significantly decreased from low value (2.5 μV) to even lower values (1.2 μV, 50% reduction for healthy control patient, FIG. 5*a*); and dramatically decreased in the TTH patient from very high values (350 μV) to lower values (250 μV, 30% reduction), respectively. Moreover, short-time after treatment effect is detected, see for example reduction of EMG from about 275 μV (25 min) at the termination of the treatment, to about 250 μV, 10 minutes after treatment has stopped. Similarly, a long-term treatment was obtained.

It is in the scope of the invention wherein the treatment is provided in which the patient is laying in a relaxed manner, wherein minimal muscle tension (especially head and shoulder muscles) is provided.

It is also in the scope of the invention wherein the treatment is provided while (i) specific physiological data, e.g., EMG and ROM; and (ii) non-specific data, e.g., blood pressure, EKG (aka ECG; e.g., heartbeat and beat to beat variability), galvanic skin response (GSR), is collected.

It is in the scope of the invention wherein the device and methods thereof are especially adapted for domestic or other out-of-clinic treatments.

It is still in the scope of the invention wherein the device is especially adapted to be provided with a 'learning mode', such that the caregiver and/or patient inputs parameters related to the maneuvers. The input is provided orally, physically (e.g., by utilizing caregiver's hands) or any other method.

It is lastly in the scope of the invention wherein the device is operated to reduce blood pressure (systole and/or diastole blood pressure), e.g., in 10% or more in respect to the pretreatment basal level.

EXAMPLE

As an example of the effectiveness of the invention herein disclosed, results of a pilot study using the invention are presented. This study was performed using an embodiment of the invention in which the protocol of motions of the physical therapy apparatus was set by using the remote control device described above, and the physical therapy device comprised the cradle described above to treat head and neck pain.

For the pilot study, performed at Bnai Zion Medical Center in Haifa, Israel, 12 patients suffering from chronic neck pain were recruited, 10 of whom completed the study. The treatment comprised 2 treatment sessions per week for 6 weeks. The manipulation protocol consisted of 20 minutes of repetitive flexion/extension oscillations in the sagittal plane at velocities of 0.5-2° $s^{-1}$ through an angle of between 15 and 40°; the velocity used and angle through which the manipulations were carried out were chosen according to the specific needs of the individual patient. Measurements were made of the Cervical Range of Motion (CROM), pain threshold trigger points (Algometry), physiological data including EMG, EKG, and GSR, and validated questionnaires: the visual analog pain scale (VAS), Neck Disability Index (NDI), quality of life (SF-36). Other specially-designed questionnaires included: Daily Activities, device Comfort and general Satisfaction.

No adverse effects of the treatment were reported; indeed, the protocol was sufficiently relaxing that some of the patients fell asleep during the physical therapy sessions. EMG recordings showed reduced bilateral activity of the trapezius muscle during the treatment. GSR data showed a significant reduction in skin conductance during the treatment, indicating marked relaxation. There was a decrease in the pain sensitivity at the trigger points as well as a significant increase in the CROM. NDI results show a significant reduction in disability.

Of the 10 patients who completed the study, only one showed no improvement at all. Two showed complete remission of pain with no recurrence of pain within hours of the treatment, while six reported a response of "good," "very good," or "excellent." Thus, a significantly positive outcome was observed for 8 out of 10 of the patients who completed the study, demonstrating the efficacy of the invention herein disclosed.

Cervical range of motion (CROM) was measured for six different movements. Of the six movements that were measured (flexion, extension, lateral bending to the right and to the left, and rotation to the right and to the left), statistically significant improvement ($P < 0.05$) was seen in extension (from an average of 47.8° to an average of)59.3° and leftward rotation (from an average of 59.8° to an average of)68.3° . A statistical analysis of the entire test (all six motions) shows that the invention herein disclosed provides statistically significant overall improvement in cervical motion ($p=0.034$).

Figure 9A:
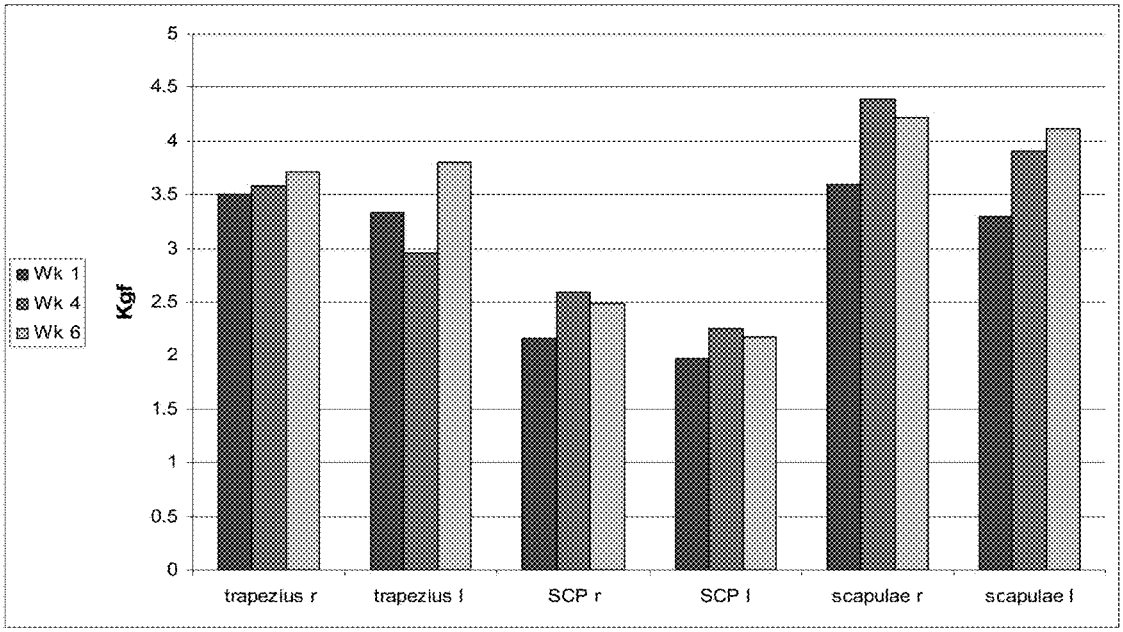
FIG. 9 presents preliminary results from a pilot study of the present invention.

Reference is now made to FIG. 9, Which presents graphically selected results from the pilot study described in the present example, FIG. 9*a* shows results for algometry. Statistically significant improvement was seen in the muscle strength for all of the relevant muscles ($p = 0.073$ for week 6 vs. week 1).

Figure 9B:
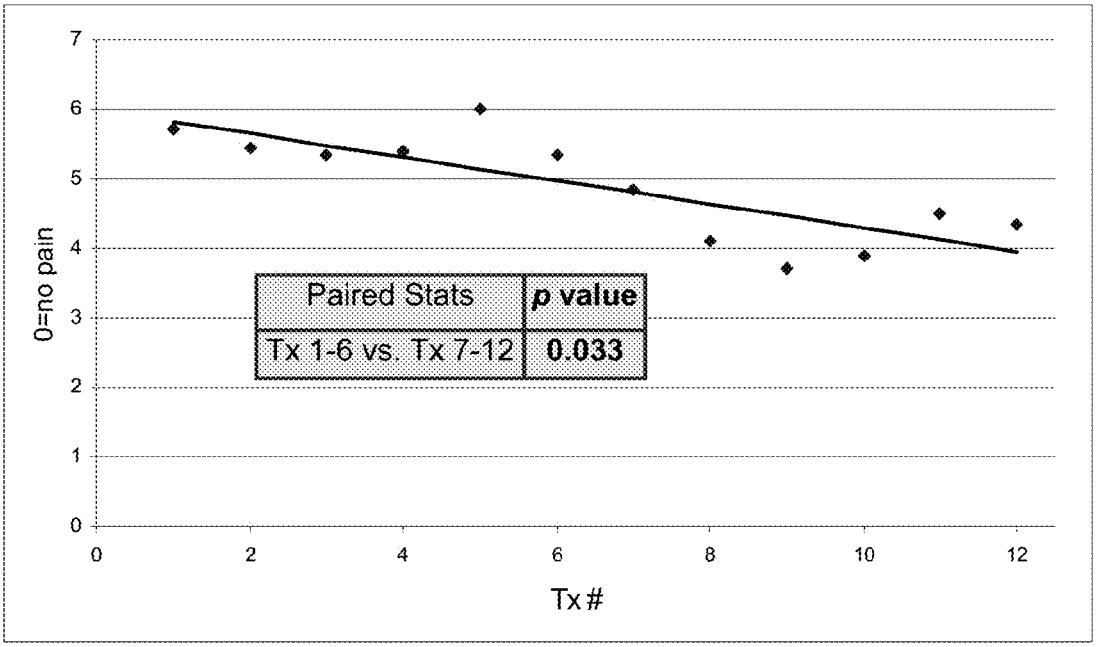
Figure 9C:
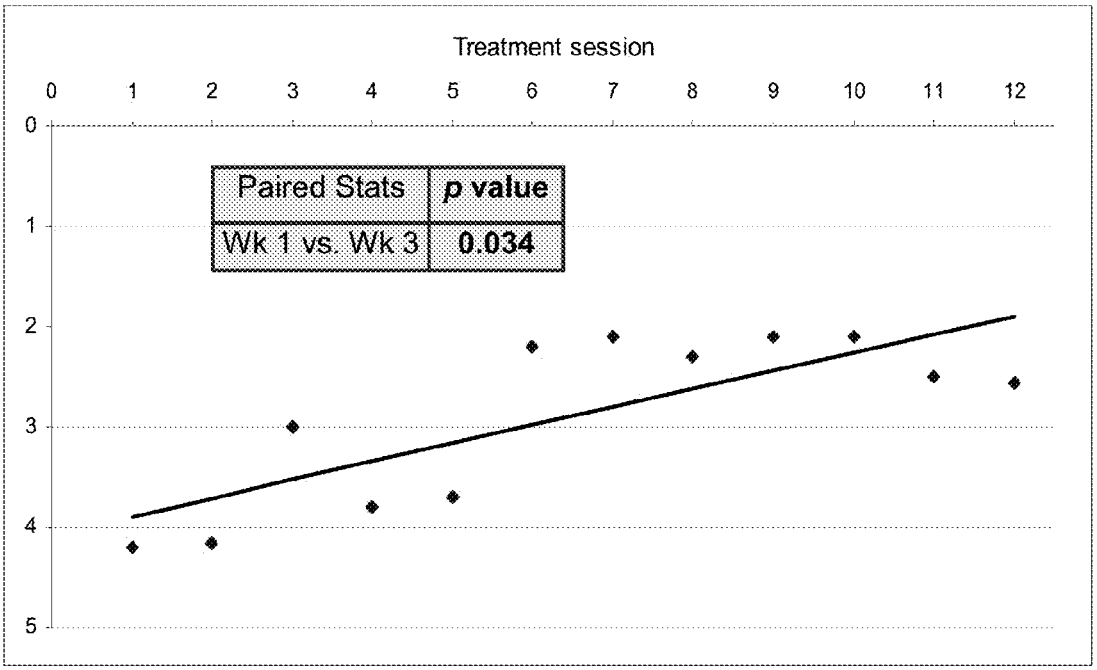

FIG. 9*b* shows results for the VAS. On this scale, 10 =unbearable pain and 0 =no pain at all. As can be seen in the figure, the average VAS level decreased from 5.7 to 4.35, an improvement of 24%. The efficacy of the method disclosed in the present invention for enabling those treated to return to their normal daily activities is illustrated in FIG. 9*c*. On this scale, 10 =cannot function at all, while 0 =fully functioning. As shown in the figure, during the course of treatment, the average ability to undergo daily activities increased by nearly 40% (from 4.2 to 2.5). This increase is statistically significant ($p = 0.033$).

Figure 9D:
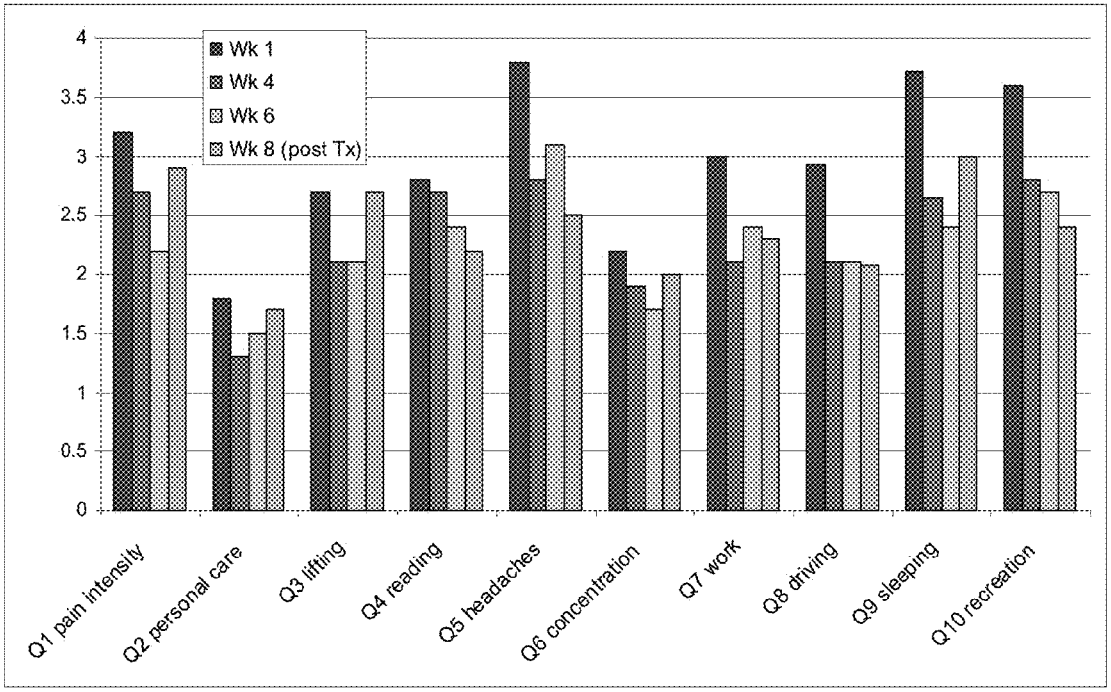
Figure 9E:
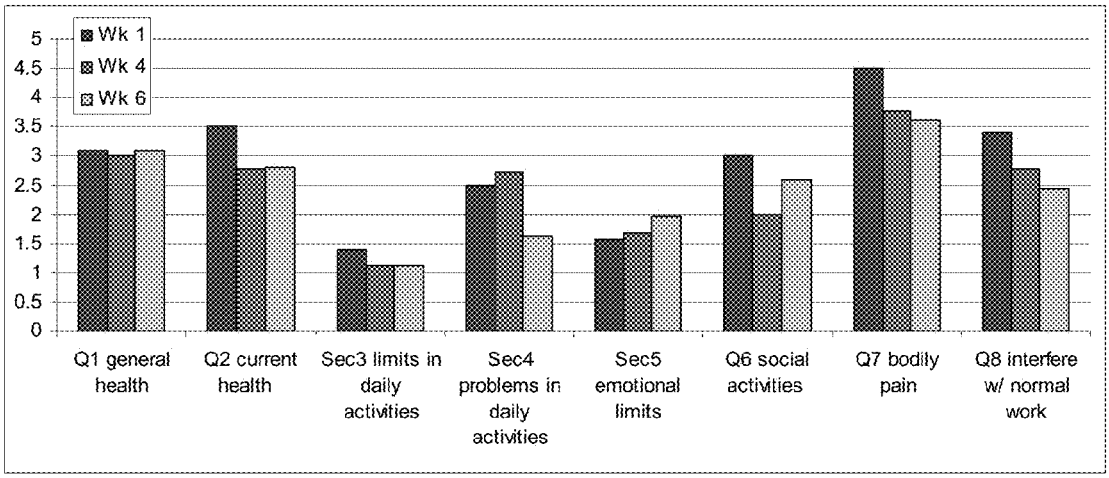

Results from the NDI and SF-36 questionnaires are shown in FIGS. 9*d* and 9*e*, respectively. As can be seen in the figures, the patients' own reports of how their neck pain affected their day-to-day activities and the state of their health showed significant improvement in all categories, e.g. $p = 0.049$ for week 8 vs. week 1 NDI.

Figure 9F:
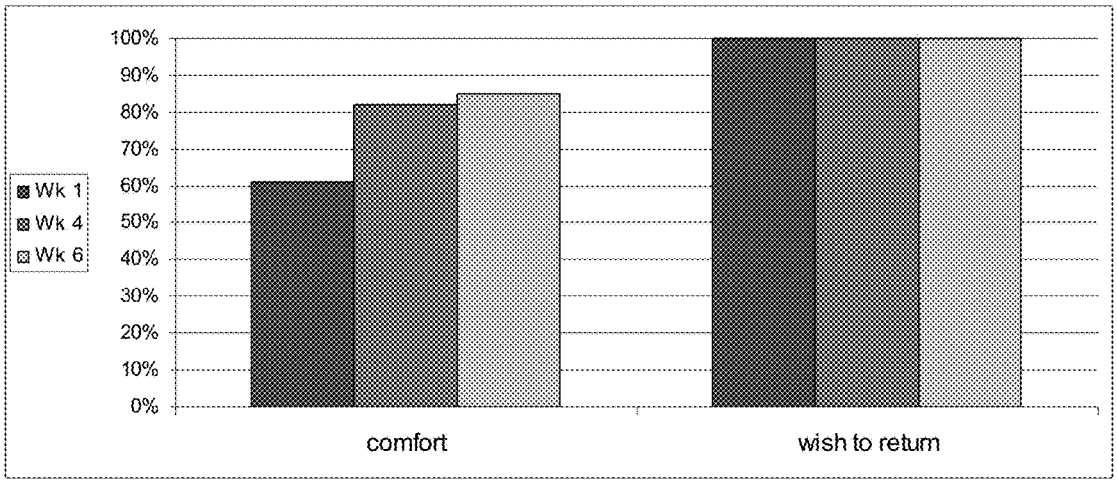
Figure 9G:
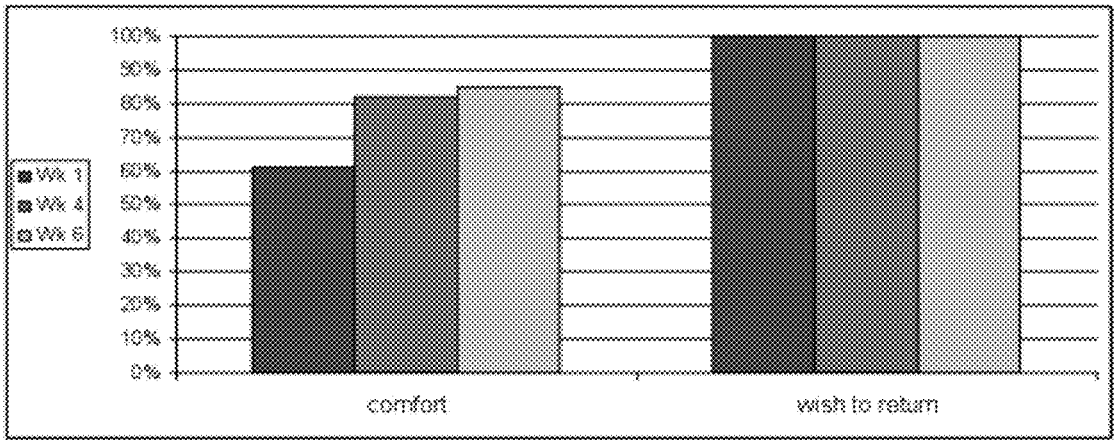
Figure 10:
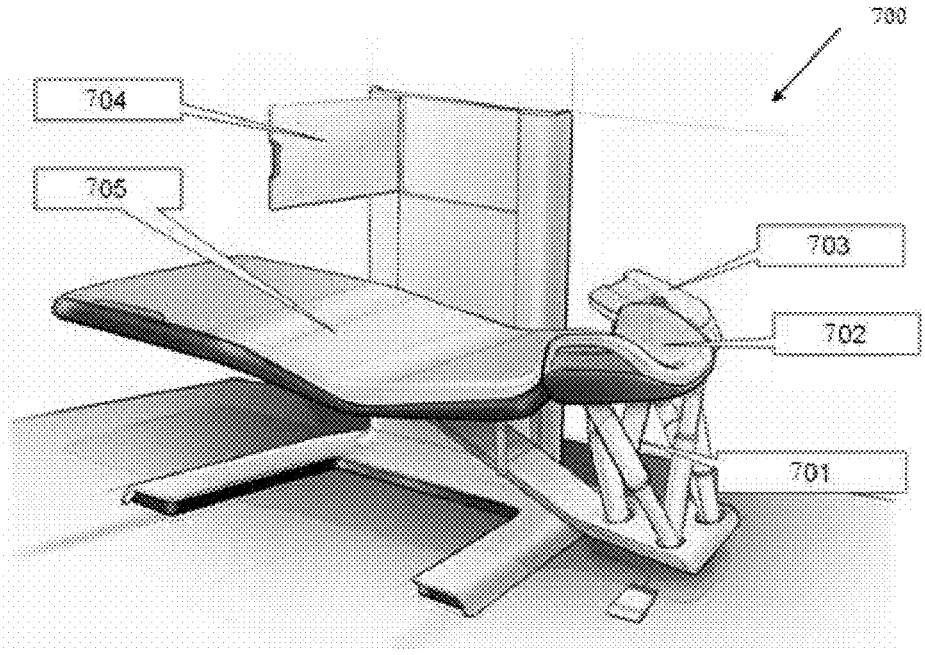
FIG. 10 illustrates another embodiment of the present invention.

Finally, FIG. 9*f* shows that the patients reported an increase in their comfort following the use of the invention disclosed herein, and that all would wish to use it again should the need arise. Reference is now made to FIG. 10, which illustrates an embodiment of remote control device 700. In the embodiment illustrated, the remote control device is adapted for controlling a physical therapy device designed to perform manipulations of the head and/or neck of a patient. The remote control device comprises 5 sections: a motorized platform 701 (e.g. hexapod); a customized adjustable head and neck cradle 702; Caregiver control unit, which enables the practitioner to define and control the treatment sessions 703; T&R (teach & repeat) sensors or cameras, capable of tracking and recording head movements as conducted by the practitioner (Teach phase) 704; and customized, height and inclination adjusted, treatment table 705.

The device allows the caregiver to tailor specific sequences of motion courses, defining range of motion, velocity and acceleration, to match the patient's needs. Such means are well-known to those skilled in the art. In addition, the motion manipulator portion comprises a plurality of sensors for determining the motions of the moveable portion relative to primary axis of the motion manipulator portion. These sensors may be of any type known in the art (e.g. linear position sensors) that is or can be adapted for transmitting in real time measurements of the motions of the moveable portion, in particular, the direction of motion, velocity, and acceleration along each of the degrees of freedom. The sensors are adapted to convert these measurements into time-dependent output signals, with the magnitudes signals being proportional to the magnitudes of the measured motions. Each of these signals is transmitted in real time to a transceiver.

In a preferred embodiment, this transceiver is a computer board (pcb) connected to caregiver control unit (703). Such boards, adapted for recording the time-dependent output of motion or position sensors, are well-known in the art, and any commercially available board of this type that has a sufficient number of inputs to be able to measure independently all of the signals output by the various sensors may be used. The transceiver then transmits the signals that it receives from the sensors to a storage unit. In preferred embodiments, this storage unit is any digital storage means convenient to the operator (e.g. the hard disk of a computer, CD-ROM, etc.), and in embodiments in which the output of the sensors is an analog signal, the analog-to-digital conversion is done by the transceiver. The control of the physical therapy device can then be done in a variety of fashions. In preferred embodiments, the signals are retrieved from storage and then transmitted as a time-dependent "command signal" to the physical therapy device; this transmission can be done by the same transceiver that is used to receive the time-dependent output signals from the sensors (including digital-to-analog conversion if necessary). The command signal is of an appropriate magnitude and duration that when it is received by the controllers of the physical therapy device, the device will reproduce the magnitudes, durations, velocities, and accelerations of the original motions of the moveable portion. The command signal is then transmitted to the physical therapy device. Thus, a series of manipulations of the moveable portion of the device leads to identical motions of the physical therapy device for manipulation of the body or a part thereof of a patient. All of the means of signal transmission and reception can be any of those that are known in the art, whether hardwired (e.g. electrical signals) or wireless.

It is a further object of this invention to disclose such a device, wherein at least one of said sensors are selected from a group consisting of stereoscopic (3D) cameras adapted for motion detection, image capture equipment adapted for tracking and recording motion or any combination thereof.

According to another embodiment of the present invention a variety of embodiment are provided for illustrating the holding and attachment of the patient's head and neck to the treatment table.

Figure 11:
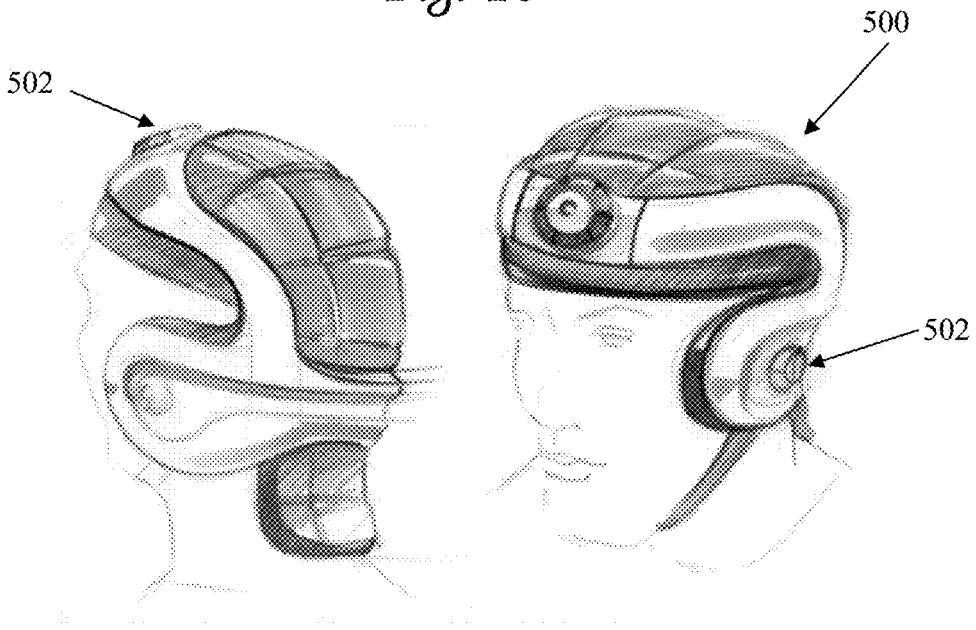
FIGS. 11-16 illustrate embodiments for the 'holding' of the patient's head and neck to a treatment table.
Figure 12:
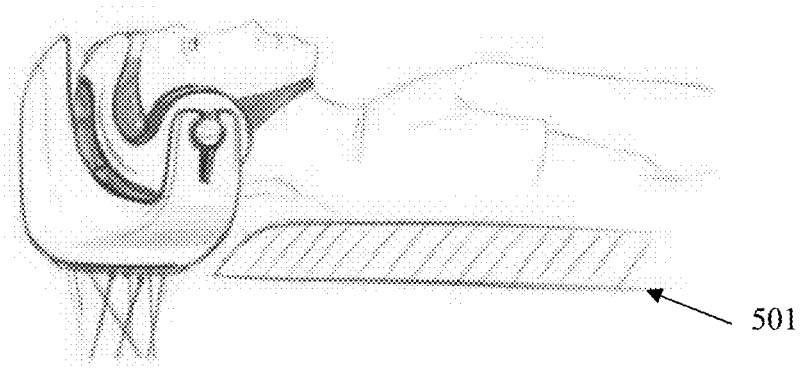

Reference is now made to FIGS. 11-12 which illustrate one embodiment 500 for ensuring the stable 'holding' of the patient's head and neck to the treatment table 501.

According to this embodiment, 'headphone'-like or 'earphone'-like element 502 are provided. According to this embodiment, said element 502 is coupled to the treatment table 501 once patient puts the same and lays on the treatment table 501.

Said coupling ensure the correct positioning of the patient and maintenance of said patient in the same position.

Figure 13:
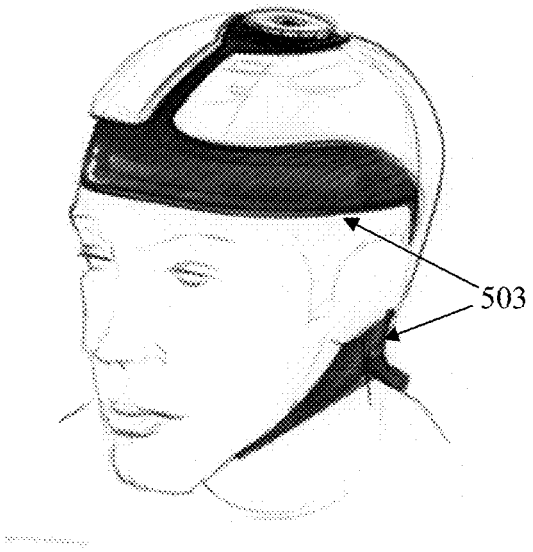
Figure 14:
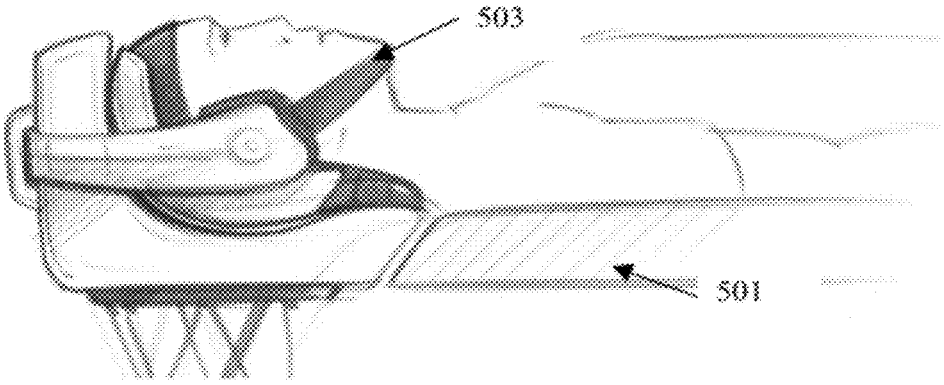

Reference is now made to FIGS. 13-14 which illustrate another embodiment for the 'holding' of the patient's head and neck to the treatment table 501.

According to this embodiment strip-like element 503 to be coupled to the patient's head and to the treatment table 501 so as to maintain the patient in position.

Figure 15:
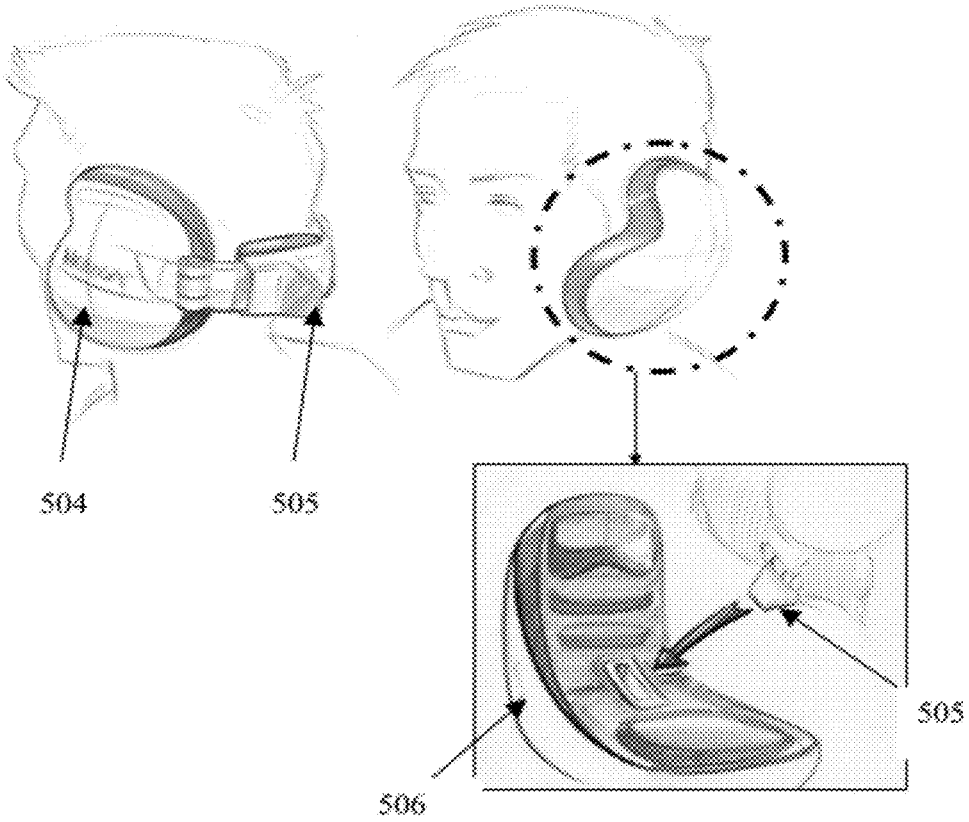
Figure 16:
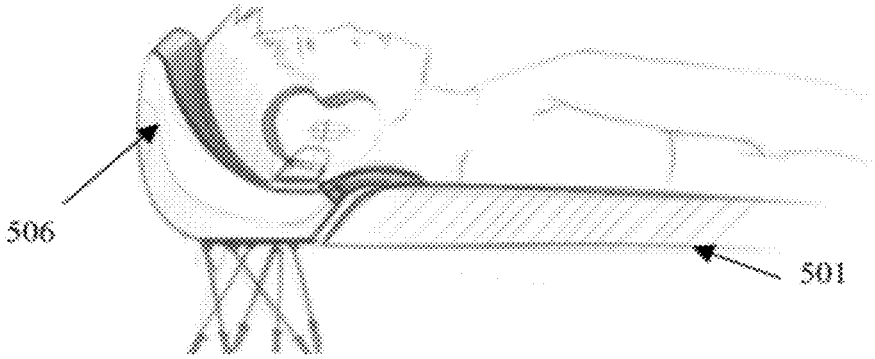

Reference is now made to FIGS. 15-16 which illustrate another embodiment for the 'holding' of the patient's head and neck to the treatment table 501.

According to this embodiment, again, 'headphone'-like or 'earphone'-like element 504 are provided. Said element 504 comprises at least one coupling member 505 to be, eventually, connected to the distal end 506 of the treatment table 501

As described above, the present invention provides a device that, according to one embodiment, will be part of the one-piece stand-alone device, and not a "joystick" or other separated tool that will be beside the treatment table. Both Teach and Repeat functions will be performed on the same unit.

Figure 17:
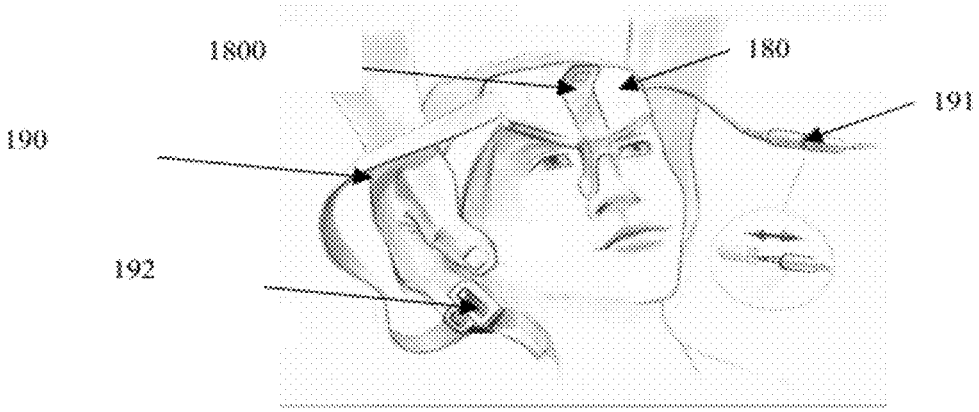
FIGS. 17-18 which illustrate another embodiment of the present invention.
Figure 18:
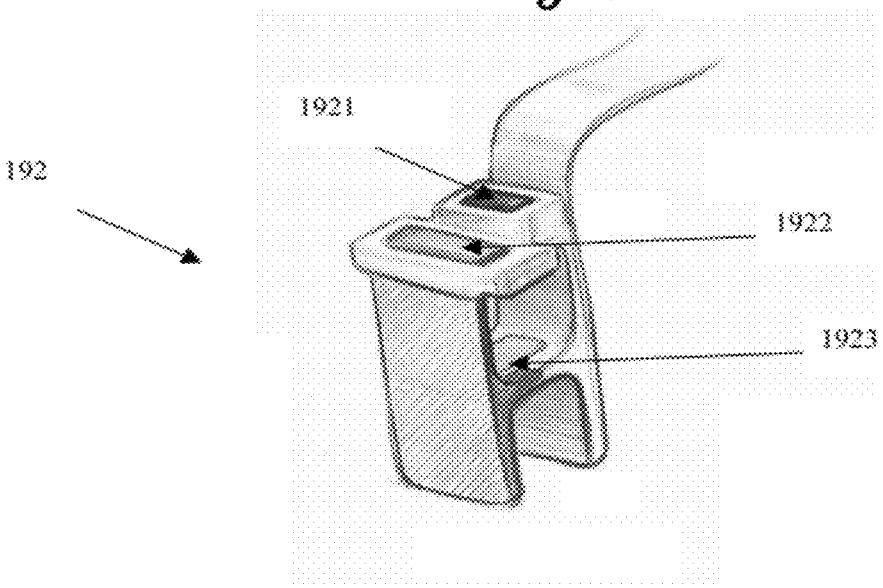

Reference is now made to FIGS. 17-18 which illustrate another embodiment of the present invention.

In this embodiment, the moveable portion of the device additionally comprises a sensor unit (180). The sensor unit (180) comprises sensors to establish the position of the head in real time during treatment. The sensors can be accelerometers, inclinometers, gyroscopic, ultrasound sensors (namely, transmitter) or any combination thereof.

It should be noted that the ultrasound transmitter, may, according to one embodiment of the present invention protrude out from the moveable portion's (or the sensors unit's) housing, see numerical reference 1800.

In one embodiment, the position of the head is communicated to display means, recording means and any combination thereof. In another embodiment, the position of the head is communicated relative to its position at some previous time.

According to this embodiment, the physician maneuvers the head (or any other treated organ); the movement of the same is recorded (by means of said sensors) and then the motion manipulation portion of the device can repeat said movements without the presence of the physician.

According to another embodiment of the present invention, the sensor unit (180) is held firmly but comfortably to the head by restraining means, preferably at least one strap (190), which is adjustable, in a non-limiting manner, by means of one of a group consisting of elasticity in at least one portion of the strap, a ratchet, a pull adjustment locked by means of a friction buckle a pull adjustment locked by means of a buckle with a tang, and any combination thereof.

A single strap will preferably surround the head in the transverse plane.

A pair of straps may surround the head with one tilted upward from the transverse plane from the sensor unit (180) to near the crown of the head, with the other tilted downward from the transverse plane from the sensor unit (180) to near the base of the head. In another embodiment, there is a transverse strap and a spring-like portion fitting over the head in the sagittal plane.

According to another embodiment of the present invention a connector 191 for power & data transfer is also provided so as to provide the sensor unit (180) with electrical power and for transmitting the recorded data.

According to another embodiment, the connector 191 is a Mini USB connector.

According to another embodiment of the present invention a manual switch (192) in communication with the therapist's hand is provided. Said manual switch (192) controls the system record and hexapod moving.

Reference is now made to FIG. 18 which provides a closer view of the manual switch (192).

According to one embodiment, the manual switch (192) comprises a hexapod moving button 1921.

According to one embodiment, the manual switch (192) comprises a system record (the "Teach") button 1922.

According to one embodiment, the manual switch (192) comprises a ring-like button's holder, partial covered with material (e.g. silicon) to improve grip 1923.

In the foregoing description, embodiments of the invention, including preferred embodiments, have been presented for the purpose of illustration and description. They are not intended to be exhaustive or to limit the invention to the precise form disclosed. Obvious modifications or variations are possible in light of the above teachings. The embodiments were chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

We claim:

1. A device for controlling a physical therapy apparatus, said physical therapy apparatus configured to accept external commands and to be controllable by means of said external commands, said device comprising:

a moveable portion configured to interact with at least one part of a body of a patient;

a base;

a motion manipulation portion in communication with said moveable portion and said base, said motion manipulation portion comprising:

a plurality of sensors configured to make time-dependent measurements of a member of a group consisting of: direction of motion, velocity, acceleration and any combination thereof of said moveable portion, said plurality of sensors configured to make said measurements for all degrees of freedom of motion of said movable portion;

measurement conversion means for converting each said time-dependent measurement into at least one time-dependent output signal proportional to said measurement, said measurement conversion means selected from a group consisting of said sensors, sensors in said physical therapy apparatus, and said device; and, means for transmitting each of said at least one time-dependent output signals to a transceiver;

a transceiver configured to receive each of said at least one time-dependent output signals and to transmit each of said at least one time-dependent output signals to a storage unit;

a storage unit configured to store said time-dependent output signals transmitted from said transceiver;

conversion means for converting said stored time-dependent output signals to a series of command signals, said command signals comprising said external commands;

communication means for transmitting said command signals to said physical therapy apparatus; and, patient parameter measurement and reporting means configured to measure and report a value of at least one patient parameter;

wherein:

said series of command signals produceable by the movement of said moveable portion, when transmitted to said physical therapy apparatus, can cause said physical therapy apparatus to undergo a series of motions identical to those of said moveable portion;

said movable portion is independently rotatable in sagittal, coronal, and horizontal planes;

said motion manipulation portion is configured for rotating said moveable portion, for a predetermined duration, in the sagittal, coronal, horizontal planes in movements defined by vector of movement angles (S, C, H) where S denotes the sagittal plane, C denotes the coronal plane, and H denotes the horizontal plane, where in all planes 0° is the position of the un-tilted part of said body, chosen from a group consisting of:

Sagittal flexion from a starting angle of (0°, 0°, 0°) to an end angle of (≤70°, 0°, 0°);

Sagittal return from a starting angle of (≤70°, 0°, 0°) to an end angle of (0°, 0°, 0°);

Coronal tilt right from a starting angle of (0°, 0°, 0°) to an end angle of (0°, ≤45°, 0°);

Coronal return right from a starting angle of (0°, ≤45°, 0°) to an end angle of (0°, 0°, 0°);

Coronal tilt left from a starting angle of (0°, 0°, 0°) to an end angle of (0°, −45°≤C≤0°, 0°);

Coronal return left from a starting angle of (0°, −45°≤C≤0°, 0°) to an end angle of (0°, 0°, 0°);

Horizontal rotation right from a starting angle of (0°, 0°, 0°) to an end angle of (0°, 0°, ≤45°);

Horizontal return right from a starting angle of (0°, 0°, ≤45°) to an end angle of (0°, 0°, 0°);

Horizontal rotation left from a starting angle of (0°, 0°, 0°) to an end angle of (0°, 0°, −45°≤H≤0°);

Horizontal return left from a starting angle of (0°, 0°, −45°≤H≤0°) to an end angle of (0°, 0°, 0°); and, in any combination of the planes thereof;

said device further comprises at least one member of a group consisting of: limiting means for limiting by a predetermined amount at least one motion of said physical therapy apparatus, said predetermined amount being a value lower than an analogous motion of said moveable part for at least part of a time during which at least one of said patient parameters is within a predetermined set of values relative to a predetermined set of boundary conditions; increasing means for increasing by a predetermined amount at least one motion of said physical therapy apparatus above a value of an analogous motion of said moveable part for at least part of a time during which at least one of said patient parameters is within a predetermined set of values relative to a predetermined set of boundary conditions;

further wherein said device comprises an adjustable head and/or neck portion and a hexapod positioner configured to manipulate said adjustable head and/or neck portion with a series of motions substantially identical to those of said moveable portion.

2. The device of claim 1, wherein said moveable portion comprises said plurality of sensors selected from a group consisting of: accelerometers, inclinometers, gyroscopic sensors, ultrasound sensors and any combination thereof, configured to determine the position of said at least one part of said body of said patient.

3. The device of claim 1, wherein at least one of said sensors is selected from a group consisting of stereoscopic (3D) cameras configured for motion detection, image capture equipment configured for tracking and recording motion, and any combination thereof.

4. The device of claim 1, additionally comprising a member selected from a group consisting of: (a) means configured to maintain said patient in a predetermined position on a treatment table; (b) connecting means configured to connect one end of said motion manipulation portion to said moveable portion, said connecting means configured such that linear motions of said moveable portion retain three degrees of freedom; (c) connecting means configured to connect one end of said motion manipulation portion to said moveable portion said connecting means configured such that rotational motions of said movable portion retain three degrees of freedom; and any combination thereof.

5. The device of claim 1, wherein at least one of the following is true:

said transceiver is a control card configured for receiving signals from said at least one sensor;

said storage unit is a digital storage means;

said means for transmitting said at least one time-dependent output signal is selected from a group consisting of hardwired and wireless; and, said communication means for transmitting each of said command signals is selected from a group consisting of hardwired and wireless.

6. The device of claim 1, further comprising software which, when executed on a computer, is configured to allow a user to recall said signals from storage and to transmit said command signals to said physical therapy apparatus a predetermined number of times with a predetermined frequency or varied by a predetermined coefficient; said device further comprising an interface and software configured to allow direct input of information and conversion of at least a part of said information to time-dependent command signals.

7. The device of claim 1, wherein said at least one patient parameter is selected from a group consisting of: medical status of said patient, physiological status of said patient, emotional status of said patient electromyography (EMG), range of motion (ROM), blood pressure, electrocardiogram (EKG), and galvanic skin response (GSR).

8. The device of claim 7, wherein at least one of the following is true:

said reporting is provided to at least one module, location of said at least one module selected from a group consisting of adjacent to said physical therapy apparatus, remote from said physical therapy apparatus; and, said device further comprises an interface between said reporting means and said communication means.

9. The device of claim 1, further comprising means for determining and reporting in real time 3D position and orientation of said at least one part of said body of said patient and of generating in real time, from said time-dependent 3D position and orientation of said at least one part of said body, a time-dependent output signal proportional to said time-dependent 3D position and orientation of said body of said patient, said means selected from a group consisting of (i) a camera system configured for determining, by means of image processing, said 3D position and orientation of said at least one part of said body of said patient; and (ii) a plurality of sensors configured to measure said 3D position and orientation of said at least one part of said body of said patient, each said sensor attachable to a member of a group consisting of: at least one part of said body of said patient, a caregiver's hands, said moveable portion, and any combination thereof; wherein each of said sensors is selected from a group consisting of: a stereoscopic (3D) camera configured for motion detection, image capture equipment configured for tracking and recording motion and any combination thereof.

10. The device of claim 1, wherein said motions are physiological movements of said body of said patient.

11. The device of claim 1, wherein said at least one part of said body of said patient is selected from a group consisting of head, neck, and any combination thereof.

12. The device of claim 1, wherein said head and/or neck portion is substantially the same as said moveable portion.

13. A method for controlling a physical therapy apparatus, said physical therapy apparatus configured to accept at least one external command and controllable by means of said at least one external command, said method comprising:

obtaining a device for controlling said physical therapy apparatus, said device comprising:

a moveable portion configured to interact with at least one part of a body of a patient;

a base;

a motion manipulation portion in communication with said moveable portion and said base, said motion manipulation portion comprising:

a plurality of sensors configured to make time-dependent measurements of a member of a group consisting of: direction of motion, velocity, acceleration and any combination thereof of said moveable portion, said plurality of sensors configured to make said measurements for all degrees of freedom of motion of said movable portion;

measurement conversion means for converting each said at least one time-dependent measurement into at least one time-dependent output signal proportional to said measurement, said measurement conversion means selected from a group consisting of said sensors, sensors in said physical therapy apparatus, and said device; and, means for transmitting each of said at least one time-dependent output signals to a transceiver;

a transceiver configured to receive each of said at least one time-dependent output signals and to transmit each of said at least one time-dependent output signals to a storage unit;

a storage unit configured to store said time-dependent output signals transmitted from said transceiver;

conversion means for converting said stored time-dependent output signals to a series of command signals, said command signals comprising said external commands;

patient parameter measurement and reporting means configured to measure and report a value of at least one patient parameter; and, communication means for transmitting said command signals to said physical therapy apparatus;

measuring and reporting a value of at least one patient parameter by means of said patient parameter measurement and reporting means;

moving said moveable portion according to a predetermined protocol;

measuring at least one time-dependent position of said moveable portion during a course of said predetermined protocol;

converting said measurements to a time-dependent signal;

transmitting said time-dependent signal to said transceiver;

storing said time-dependent signal by using said storage unit;

converting said time-dependent signal to a time-dependent command signal; and, transmitting said time-dependent command signal to said physical therapy apparatus;

wherein:

moving said moveable portion causes said physical therapy apparatus to undergo a series of motions identical to those of said moveable portion;

said movable portion is independently rotatable in the sagittal, coronal, and horizontal planes;

said motion manipulation portion is configured for rotating said moveable portion, for a predetermined duration, in the sagittal, coronal, horizontal planes in movements defined by vector of movement angles (S, C, H) where S denotes the sagittal plane, C denotes the coronal plane, and H denotes the horizontal plane, where in all planes 0° is the position of the un-tilted part of said body, chosen from a group consisting of:

sagittal flexion from a starting angle of (0°, 0°, 0°) to an end angle of (≤70°, 0°, 0°);

sagittal return from a starting angle of (≤70°, 0°, 0°) to an end angle of (0°, 0°, 0°);

coronal tilt right from a starting angle of (0°, 0°, 0°) to an end angle of (0°, ≤45°, 0°);

coronal return right from a starting angle of (0°, ≤45°, 0°) to an end angle of (0°, 0°, 0°);

coronal tilt left from a starting angle of (0°, 0°, 0°) to an end angle of (0°, −45°≤C≤0°, 0°);

coronal return left from a starting angle of (0°, −45°≤C≤0°, 0°) to an end angle of (0°, 0°, 0°);

horizontal rotation right from a starting angle of (0°, 0°, 0°) to an end angle of (0°, 0°, ≤45°);

horizontal return right from a starting angle of (0°, 0°, ≤45°) to an end angle of (0°, 0°, 0°);

horizontal rotation left from a starting angle of (0°, 0°, 0°) to an end angle of (0°, 0°, −45°≤H≤0°);

horizontal return left from a starting angle of (0°, 0°, −45°≤H≤0°) to an end angle of (0°, 0°, 0°); and, in any combination of the planes thereof;

said method comprises a step selected from a group consisting of: limiting by a predetermined amount at least one motion of said physical therapy apparatus, said predetermined amount being a value lower than an analogous motion of said moveable part for at least part of a time during which at least one of said patient parameters is within a predetermined set of values relative to a predetermined set of boundary conditions; and, increasing by a predetermined amount at least one motion of said physical therapy apparatus above a value of an analogous motion of said moveable part for at least part of a time during which at least one of said patient parameters is within a predetermined set of values relative to a predetermined set of boundary conditions; and any combination thereof;

further wherein said step of obtaining said device further comprises step of providing said device with an adjustable head and/or neck portion and a hexapod positioner configured to manipulate said adjustable head and/or neck portion with a series of motions substantially identical to those of said moveable portion.

14. The method of claim 13, further comprising steps of:

recalling said time-dependent signal from said storage unit;

converting said recalled time-dependent signal to a time-dependent command signal;

transmitting said time-dependent command signal to said physical therapy apparatus; and, repeating a predetermined number of times the steps of recalling said time-dependent signal from said storage unit, converting said recalled time-dependent signal to a time-dependent command signal and transmitting said time-dependent command signal to said physical therapy apparatus.

15. The method of claim 13, further comprising steps of:

manually altering the orientation of said physical therapy apparatus according to a predetermined protocol;

transmitting, during the course of said predetermined protocol, at least one time-dependent signal proportional to the orientation of said physical therapy apparatus to a storage device configured for storing time-dependent signals;

storing said at least one transmitted time-dependent signal in said storage device;

recalling said time-dependent signal from said storage device;

converting said recalled time-dependent signal to a time-dependent command signal;

transmitting said time-dependent command signal to said physical therapy apparatus; and, repeating a predetermined number of times the steps of recalling said time-dependent signal from said storage device, converting said recalled time-dependent signal to a time-dependent command signal, and transmitting said time-dependent command signal to said physical therapy apparatus ;

wherein transmitting said command signal causes said physical therapy apparatus to undergo substantially the same motions produced by said predetermined protocol.

16. The method of claim 15, comprising a step of placing said at least one part of said body of said patient in a position such that said alterations in orientation of said physical therapy apparatus will manipulate said at least one part of said body of said patient according to a predetermined protocol, said additional step of placing said at least one part of said body of said patient in said position such that said alterations in said orientation of said physical therapy apparatus will manipulate said at least one part of said body of said patient according to a predetermined protocol occurs after the step of storing said at least one transmitted time-dependent signal in said storage device and prior to the step of recalling said time-dependent signal from said storage device.

17. The method of claim 15, additionally comprising a step of providing means for maintaining said patient in a predetermined position on a treatment table.

18. An apparatus for providing physical therapy for a treated part of a body of a patient, said treated part comprising at least a part of said body of said patient, by controllably maneuvering said treated part, said apparatus comprising:

a cradle configured for holding said treated part stably and comfortably;

a maneuverable platform upon which said cradle rests, comprising maneuvering means configured for maneuvering said platform; and controlling means in communication with said maneuvering means, said controlling means configured to control said physical therapy by accepting external commands, said controlling means comprising:

a moveable portion configured for interacting with said treated part;

a base;

a motion manipulation portion in communication with said moveable portion and said base, said motion manipulation portion comprising:

a plurality of sensors configured to make time-dependent measurements of a member of a group consisting of: direction of motion, velocity, acceleration and any combination thereof of said moveable portion, said plurality of sensors configured to make said measurements for all degrees of freedom of motion of said movable portion;

measurement conversion means for converting each of said time-dependent measurements into at least one time-dependent output signal proportional to said measurement, said measurement conversion means selected from a group consisting of said sensors, sensors in said physical therapy apparatus, and said device; and, means for transmitting each of said at least one time-dependent output signals to a transceiver;

a transceiver configured to receive each of said at least one time-dependent output signals and transmitting each of said at least one time-dependent output signals to a storage unit;

a storage unit configured to store said time-dependent output signals transmitted from said transceiver;

conversion means for converting said stored time-dependent output signals to a series of command signals;

means for transmitting said command signals to said controlling means; and, patient parameter measurement and reporting means configured to measure and report a value of at least one patient parameter;

wherein:

said maneuvering of said treated part is characterized by parameters selected from a predetermined set of allowed movements;

a series of command signals are produced by the movement of said moveable portion, which, when transmitted to said physical therapy apparatus, will cause said physical therapy apparatus to undergo a series of motions identical to those of said moveable portion;

said movable portion is independently rotatable in the sagittal, coronal, and horizontal planes;

said motion manipulation portion is configured for rotating said moveable portion, for a predetermined duration, in the sagittal, coronal, horizontal planes in movements defined by vector of movement angles (S, C, H) where S denotes the sagittal plane, C denotes the coronal plane, and H denotes the horizontal plane, where in all planes 0° is the position of the un-tilted body part, selected from a group consisting of:

sagittal flexion from a starting angle of (0°, 0°, 0°) to an end angle of (≤70°, 0°, 0°);

sagittal return from a starting angle of (≤70°, 0°, 0°) to an end angle of (0°, 0°, 0°);

coronal tilt right from a starting angle of (0°, 0°, 0°) to an end angle of (0°, ≤45°, 0°);

coronal return right from a starting angle of (0°, ≤45°, 0°) to an end angle of (0°, 0°, 0°);

coronal tilt left from a starting angle of (0°, 0°, 0°) to an end angle of (0°, −45°≤C≤0°, 0°);

coronal return left from a starting angle of (0°, −45°≤C≤0°, 0°) to an end angle of (0°, 0°, 0°);

horizontal rotation right from a starting angle of (0°, 0°, 0°) to an end angle of (0°, 0°, ≤45°) ;

horizontal return right from a starting angle of (0°, 0°, ≤45°) to an end angle of (0°, 0°, 0°);

horizontal rotation left from a starting angle of (0°, 0°, 0°) to an end angle of (0°, 0°, −45°≤H≤0°);

horizontal return left from a starting angle of (0°, 0°, −45°≤H≤0°) to an end angle of (0°, 0°, 0°);

and in any combination of the planes thereof;

said device further comprises at least one member of group consisting of: limiting means for limiting by a predetermined amount at least one motion of said physical therapy apparatus, said predetermined amount being a value lower than an analogous motion of said moveable part for at least part of a time during which at least one of said patient parameters is within a predetermined set of values relative to a predetermined set of boundary conditions; and, increasing means for increasing by a predetermined amount at least one motion of said physical therapy apparatus above a value of an analogous motion of said moveable part for at least part of a time during which at least one of said patient parameters is within a predetermined set of values relative to a predetermined set of boundary conditions;

wherein said maneuverable platform is a -hexapod positioner configured to manipulate said cradle with a series of motions substantially identical to those of said moveable portion.

19. The apparatus of claim 18, wherein said moveable portion comprises a second plurality of sensors configured to determine 3D position and orientation of at least one part of said body of said patient, said sensors selected from a group consisting of an accelerometer, an inclinometer, a gyroscope, an ultrasound sensor and any combination thereof.

20. The apparatus of claim 18, wherein said moveable portion is of substantially the same shape and dimensions as that portion of said physical therapy apparatus that is configured for interacting with said treated part.

21. The apparatus of claim 18, wherein at least one of the following is true:

at least one of said plurality of sensors is selected from a group consisting of stereoscopic (3D) cameras configured for motion detection, image capture equipment configured for tracking and recording motion, and any combination thereof;

said apparatus additionally comprises means configured to maintain said patient in a predetermined position on a treatment table; and, motion of said treated part follows a lobular three dimensional path.

22. The apparatus of claim 18, additionally comprising a member selected from a group consisting of: (a) processing means for either online or offline determination of said parameters; (b) processing means for either online or offline control of said parameters; (c) means for presenting audiovisual entertainment during use of said apparatus, said means for presenting audiovisual entertainment selected from a group consisting of (i) means for playing music, (ii) means for presenting a virtual reality display and any combination thereof; (d) reporting means for reporting said at least one patient parameter to a member of a module selected from a group consisting of an adjacent module, a remote module, and any combination thereof; (e) a feedback interconnection between said detecting means and said maneuverable platform configured to update at least one said maneuvering parameter; and (f) any combination thereof.

23. The apparatus of claim 18, wherein said allowed movements comprise physiological movements of said treated part.

24. The apparatus of claim 18, wherein said patient parameter is selected from a group consisting of: medical condition of said patient, physiological condition of said patient, emotional condition of said patient, electromyography (EMG), electrocardiogram (EKG), galvanic skin response (GSR) and any combination thereof.

* * * * *